US008271123B2

(12) United States Patent
Yamada

(10) Patent No.: US 8,271,123 B2
(45) Date of Patent: Sep. 18, 2012

(54) EMBROIDERY DATA GENERATING APPARATUS AND NON-TRANSITORY COMPUTER-READABLE MEDIUM STORING EMBROIDERY DATA GENERATING PROGRAM

(75) Inventor: Kenji Yamada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 129 days.

(21) Appl. No.: 12/967,664

(22) Filed: Dec. 14, 2010

(65) Prior Publication Data

US 2011/0160894 A1 Jun. 30, 2011

(30) Foreign Application Priority Data

Dec. 28, 2009 (JP) ..... 2009-298409

(51) Int. Cl.
*D05C 5/02* (2006.01)

(52) U.S. Cl. ..... 700/138; 112/470.01

(58) Field of Classification Search ..... 700/136–138; 112/102.5, 453, 470.01, 470.06, 475.18, 112/475.19
See application file for complete search history.

(56) References Cited

U.S. PATENT DOCUMENTS 5,343,401 A * 8/1994 Goldberg et al. ..... 700/138
5,701,830 A * 12/1997 Muto ..... 112/102.5
5,794,553 A * 8/1998 Futamura ..... 112/102.5
5,839,380 A * 11/1998 Muto ..... 112/102.5
6,324,441 B1 11/2001 Yamada
6,629,015 B2 9/2003 Yamada
7,991,500 B2 * 8/2011 Roos ..... 700/138
2007/0162177 A1 * 7/2007 Yamada ..... 700/138
2007/0233309 A1 * 10/2007 Yamada ..... 700/138
2007/0233310 A1 * 10/2007 Yamada ..... 700/138

FOREIGN PATENT DOCUMENTS

JP A-2000-288275 10/2000
JP A-2001-259268 9/2001
JP A-2002-263386 9/2002

* cited by examiner

*Primary Examiner* — Nathan Durham
(74) *Attorney, Agent, or Firm* — Oliff & Berridge, PLC

(57) ABSTRACT

An embroidery data generating apparatus includes a thread color acquisition device, a first line segment data generating device, an expanded data generating device, a second line segment data generating device, a color allocating device, a connecting line segment data generating device, and an embroidery data generating device. The thread color acquisition device acquires a plurality of available thread colors. The first line segment data generating device generates first line segment data. The expanded data generating device generates expanded data. The second line segment data generating device generates second line segment data. The color allocating device allocates an embroidery thread color to each piece of the second line segment data. The connecting line segment data generating device generates connecting line segment data. The embroidery data generating device generates embroidery data.

18 Claims, 28 Drawing Sheets

FIG. 11

X

Y

| | | | | | | | |
|---|---|---|---|---|---|---|---|
| −1 | −1 | −1 | −1 | −1 | −1 | −1 | −1 |
| −1 | −1 | −1 | −1 | −1 | −1 | −1 | −1 |
| −1 | −1 | −1 | −1 | −1 | −1 | −1 | −1 |
| −1 | −1 | −1 | −1 | −1 | −1 | −1 | −1 |
| −1 | −1 | −1 | −1 | −1 | −1 | −1 | −1 |
| −1 | −1 | −1 | −1 | −1 | −1 | −1 | −1 |
| −1 | −1 | −1 | −1 | −1 | −1 | −1 | −1 |
| −1 | −1 | −1 | −1 | −1 | −1 | −1 | −1 |

FIG. 13

X →

Y ↓

| | | | | | | | |
|---|---|---|---|---|---|---|---|
| 0 | 0 | 0 | 0 | −1 | −1 | −1 | −1 |
| −1 | −1 | −1 | −1 | −1 | −1 | −1 | −1 |
| −1 | −1 | −1 | −1 | −1 | −1 | −1 | −1 |
| −1 | −1 | −1 | −1 | −1 | −1 | −1 | −1 |
| −1 | −1 | −1 | −1 | −1 | −1 | −1 | −1 |
| −1 | −1 | −1 | −1 | −1 | −1 | −1 | −1 |
| −1 | −1 | −1 | −1 | −1 | −1 | −1 | −1 |
| −1 | −1 | −1 | −1 | −1 | −1 | −1 | −1 |

EMBROIDERY DATA GENERATING APPARATUS AND NON-TRANSITORY COMPUTER-READABLE MEDIUM STORING EMBROIDERY DATA GENERATING PROGRAM

CROSS-REFERENCE TO RELATED APPLICATION

This application claims priority to Japanese Patent Application No. 2009-298409, filed Dec. 28, 2009, the content of which is hereby incorporated herein by reference in its entirety.

BACKGROUND

The present disclosure relates to an embroidery data generating apparatus and a non-transitory computer-readable medium that stores an embroidery data generating program that generate embroidery data to sew an embroidery pattern using an embroidery sewing machine.

An embroidery data generating apparatus is known that acquires image data from an image such as a photo or an illustration etc. and generates embroidery data to be used to sew an embroidery pattern based on the image data. In the embroidery data generating apparatus, the embroidery data is generated using the following procedure. First, based on the image data, line segment data pieces are generated that indicate shapes and relative positions of stitches. Then, thread color data is allocated to each of the line segment data pieces. The thread color data indicates a color of each of the stitches. Next, if a same thread color is allocated to a plurality of line segment data pieces representing a plurality of line segments, connecting line segment data is generated that indicates at least one connecting line segment that connects the plurality of line segments. If stitches formed on the connecting line segment are to be covered by other stitches that are sewn later, needle drop point data is generated that causes a running stitch to be stitched on the connecting line segment. Then, the embroidery data is generated that indicates a sewing order, the thread color, the relative position of the needle drop point and a stitch type.

When expressing an image by an embroidery pattern, compared to a case in which there is a low ratio of long stitches, when there is a high ratio of long stitches, an appearance is beautiful and the embroidery pattern has a natural finish. Compared to a case in which the stitches are formed in an embroidery area with an non-uniform density, when the stitches are formed in the embroidery area with a substantially uniform density, the appearance is beautiful and the embroidery pattern has a natural finish.

SUMMARY

In the known embroidery data generating apparatus, line segment data pieces are generated without sufficiently taking into account a line segment L2 that overlaps with a line segment L1 represented by the line segment data, nor sufficiently taking into account a surrounding line segment L3 that overlaps with surrounding pixels in the vicinity of the pixels of the line segment L2. As a consequence, when the embroidery data is generated based on the line segment data and on the connecting line segment data, there are cases in which the embroidery pattern has an unnatural finish.

Various exemplary embodiments of the broad principles derived herein provide an embroidery data generating apparatus that generates, based on an image data, embroidery data which forms an embroidery pattern with a more natural finish, and a non-transitory computer-readable medium that stores an embroidery data generating program.

Exemplary embodiments provide an embroidery data generating apparatus that includes a thread color acquisition device, a first line segment data generating device, an expanded data generating device, a second line segment data generating device, a color allocating device, a connecting line segment data generating device, and an embroidery data generating device. The thread color acquisition device acquires, as a plurality of available thread colors, colors of threads to be used in sewing an embroidery pattern. The first line segment data generating device that reads at least one of the pixels as a first target pixel from a plurality of pixels included in an image, and generates first line segment data that is data representing a first line segment based on target image data that is data representing the first target pixel, the first line segment is a line segment that expresses the first target pixel. The expanded data generating device generates, based on the first line segment data generated by the first line segment data generating device, expanded data that associates angle data with a pixel for each of the plurality of pixels overlapping with the first line segment. The angle data represents an extension direction of the first line segment as an angle of the first line segment with respect to a reference. The second line segment data generating device reads one of the pixels as a second target pixel from the plurality of pixels included in the expanded data to identify a pixel as an extension direction pixel, and generates second line segment data that represents a second line segment. The pixel identified as the extension direction pixel is in an extension direction as seen from the second target pixel. The extension direction is represented by target angle data that is the angle data associated with the second target pixel. The pixel identified as the extension direction pixel is associated with angle data indicating a similar angle to an angle indicated by the target angle data. The second line segment is a line segment that overlaps with the second target pixel and the extension direction pixel. The color allocating device allocates, from among the plurality of available thread colors acquired by the thread color acquisition device, to each piece of the second line segment data a thread color that expresses a color of a pixel that overlaps with the second line segment, as an embroidery thread color. The second line segment data represents the second line segment. The connecting line segment data generating device generates, when there is a plurality of line segments of the same color, which are line segments represented by the second line segment data having the same embroidery thread color allocated by the color allocating device, connecting line segment data that is data representing connecting line segments, which are line segments to connect the plurality of line segments of the same color. The embroidery data generating device generates embroidery data including a sewing order, thread color data and needle drop point data, based on the second line segment data generated by the second line segment data generating device, the embroidery thread color allocated to each piece of the second line segment data by the color allocating device and the connecting line segment data generated by the connecting line segment data generating device.

Exemplary embodiments further provide a non-transitory computer-readable medium storing an embroidery data generating program. The program includes instructions that cause a controller to perform the steps of acquiring, as a plurality of available thread colors, colors of a plurality of threads to be used in sewing an embroidery pattern, reading at least one of the pixels as a first target pixel from among a plurality of pixels included in an image, and generating first line segment data that is data representing a first line segment based on target image data that is data representing the first target pixel, the first line segment being a line segment that expresses the first target pixel, generating, based on the first line segment data, expanded data that associates angle data with pixel for each of the plurality of pixels overlapping with the first line segment, the angle data representing an extension direction of the first line segment as an angle of the first line segment with respect to a reference, reading one of the pixels as a second target pixel from the plurality of pixels included in the expanded data to identify a pixel as an extension direction pixel and generating second line segment data that represents a second line segment, the pixel identified as the extension direction pixel being in an extension direction as seen from the second target pixel, the extension direction being represented by target angle data that is the angle data associated with the second target pixel, the pixel identified as the extension direction pixel being associated with angle data indicating a similar angle to an angle indicated by the target angle data, the second line segment being a line segment that overlaps with the second target pixel and the extension direction pixel, allocating, from among the plurality of available thread colors, to each piece of the second line segment data a thread color that expresses a color of a pixel that overlaps with the second line segment as an embroidery thread color, the second line segment data representing the second line segment, generating, when there is a plurality of line segments of the same color, which are line segments represented by the second line segment data having the same embroidery thread color, connecting line segment data that is data representing connecting line segments, which are line segments to connect the plurality of line segments of the same color, and generating embroidery data including a sewing order, thread color data and needle drop point data, based on the second line segment data, the embroidery thread color allocated to each piece of the second line segment data and the connecting line segment data.

BRIEF DESCRIPTION OF THE DRAWINGS

Exemplary embodiments will be described below in detail with reference to the accompanying drawings in which:

FIG. 11 is an explanatory diagram of second expanded data of the second specific example;

FIG. 13 is an explanatory diagram of the second expanded data of the second specific example after processing at Step S322 shown in FIG. 12 is performed;

DETAILED DESCRIPTION

Hereinafter, first to fourth embodiments of the present disclosure will be explained with reference to the drawings. The drawings are used to explain technological features that the present disclosure can utilize, and a configuration of a device that is described, flowcharts of various types of processing, and the like do not limit the present disclosure to only that configuration, that processing, and the like, but are merely explanatory examples.

Figure 1:
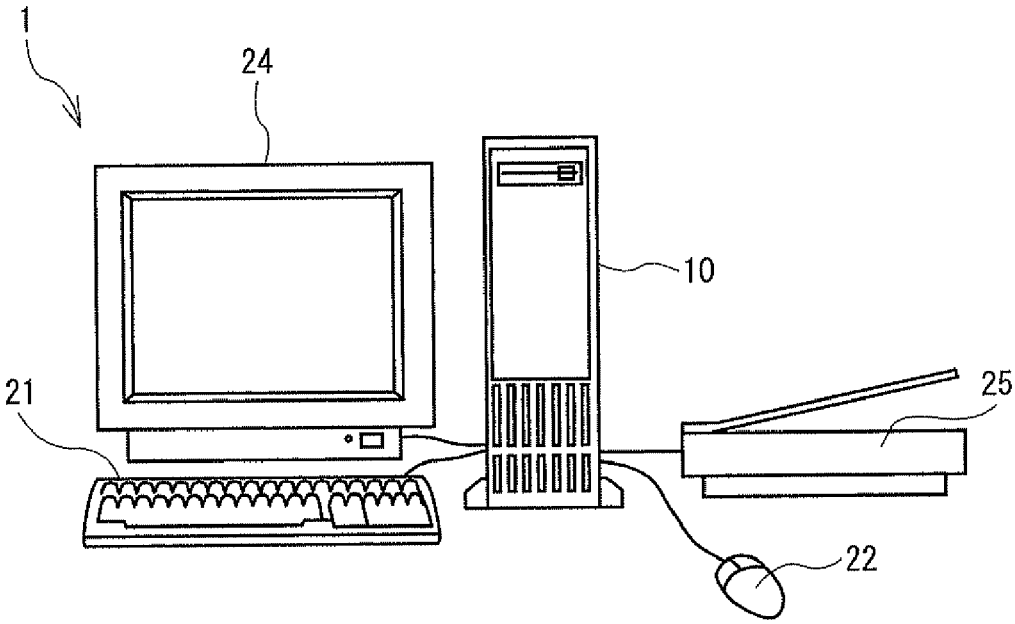
FIG. 1 is an overall configuration diagram that shows a physical configuration of an embroidery data generating apparatus.
Figure 2:
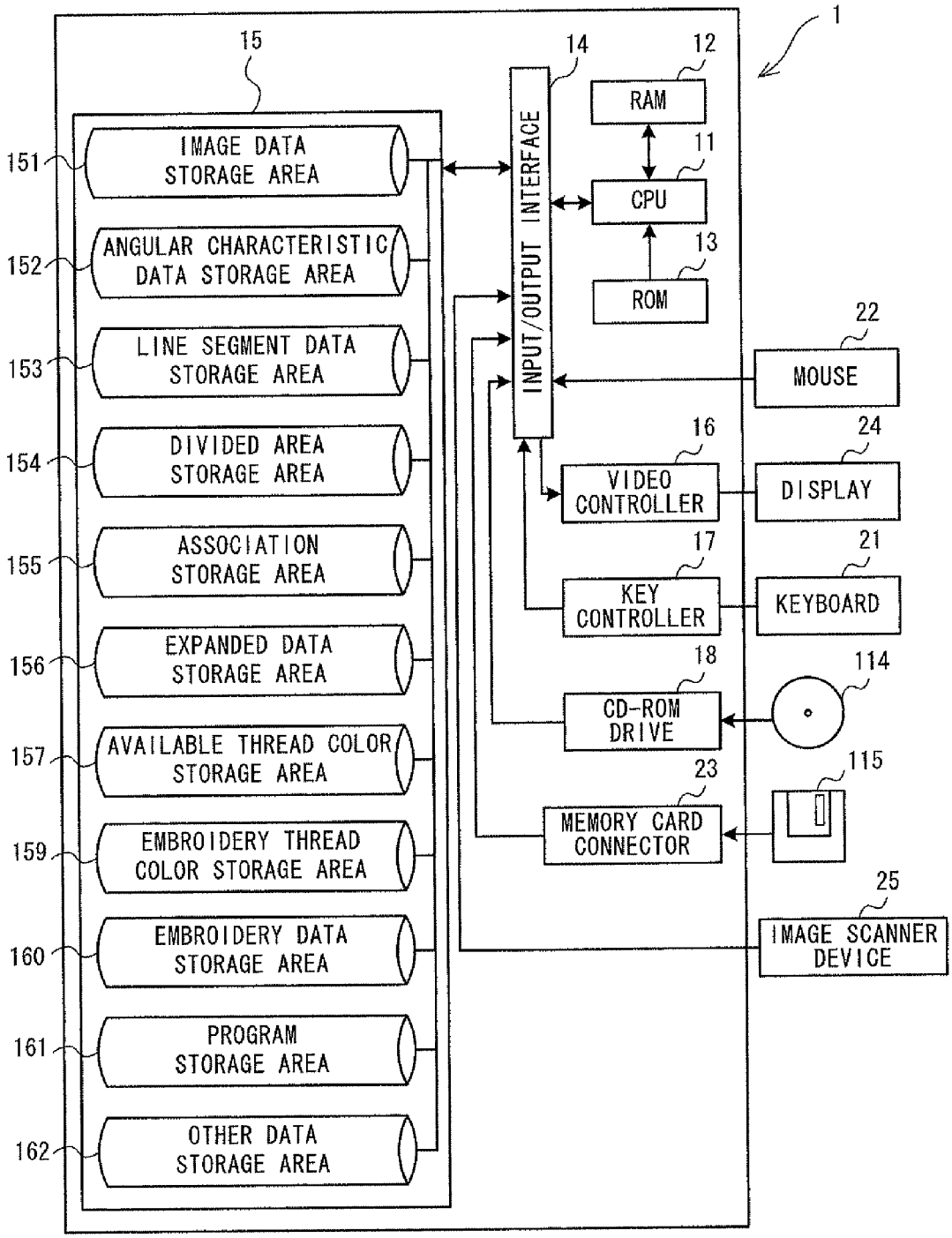
FIG. 2 is a block diagram that shows an electrical configuration of the embroidery data generating apparatus.

First, a common configuration of an embroidery data generating apparatus 1 according to the first to fourth embodiments will be explained with reference to FIGS. 1 and 2. The embroidery data generating apparatus 1 is a device that generates data for an embroidery pattern that will be sewn by an embroidery sewing machine 3 that will be described later (refer to FIG. 3). In particular, the embroidery data generating apparatus 1 can generate embroidery data to be used to sew an embroidery pattern that will represent an image based on image data acquired from the image, such as a photo or an illustration etc. As shown in FIG. 1, the embroidery data generating apparatus 1 may be, for example, a general-purpose device such as a personal computer or the like. The embroidery data generating apparatus 1 is provided with a main device body 10. The embroidery data generating apparatus 1 is further provided with a keyboard 21, a mouse 22, a display 24, and an image scanner 25 that are connected to the main device body 10. The keyboard 21 and the mouse 22 are each input devices. The display 24 displays information.

Next, an electrical configuration of the embroidery data generating apparatus 1 will be explained with reference to FIG. 2. As shown in FIG. 2, the embroidery data generating apparatus 1 is provided with a CPU 11 that is a controller that performs control of the embroidery data generating apparatus 1. A RAM 12, a ROM 13, and an input/output (I/O) interface 14 are connected to the CPU 11. The RAM 12 temporarily stores various types of data. The ROM 13 stores a BIOS and the like. The input/output interface 14 mediates exchanges of data. A hard disk drive (HDD) 15, the mouse 22, a video controller 16, a key controller 17, a CD-ROM drive 18, a memory card connector 23, and the image scanner 25 are connected to the I/O interface 14. The embroidery data generating apparatus 1 may also be provided with an external interface for connecting to an external device and a network, although this is not shown in FIG. 2.

The HDD 15 has a plurality of storage areas that include an embroidery data storage area 160 and a program storage area 161. Embroidery data that is stored in the embroidery data storage area 160. The embroidery data is generated by the CPU 11 when an embroidery data generating program is executed. The embroidery data is data that will be used when the embroidery sewing machine 3 (refer to FIG. 3) performs embroidering. The embroidery data includes a sewing order, needle drop point data and thread color data. A plurality of programs that include the embroidery data generating program that are to be executed by the CPU 11 are stored in the program storage area 161. In a case where the embroidery data generating apparatus 1 is a dedicated device that is not provided with the hard disk drive 15, the embroidery data generating program may be stored in the ROM 13.

In addition to the storage areas that are described above, various types of storage areas are included in the HDD 15, in which is stored data that is acquired in a process of executing main processing in accordance with the embroidery data generating program. More specifically, the HDD 15 includes an image data storage area 151, an angular characteristic data storage area 152, a line segment data storage area 153 and a divided area storage area 154. The HDD 15 is further provided with an association storage area 155, an expanded data storage area 156, an available thread color storage area 157 and an embroidery thread color storage area 159. Additionally, the HDD 15 is provided with an other data storage area 162. Default values and setting values etc. for various parameters, for example, are stored in the other data storage area 162 as other data pieces.

The display 24 is connected to the video controller 16, and the keyboard 21 is connected to the key controller 17. A CD-ROM 114 can be inserted into the CD-ROM drive 18. For example, when the embroidery data generating program is installed, the CD-ROM 114, in which is stored the embroidery data generating program that is a control program of the embroidery data generating apparatus 1, is inserted into the CD-ROM drive 18. The embroidery data generating program is then set up and is stored in the program storage area 161 of the HDD 15. A memory card 115 can be connected to the memory card connector 23, and information can be read from the memory card 115 and written to the memory card 115.

Figure 3:
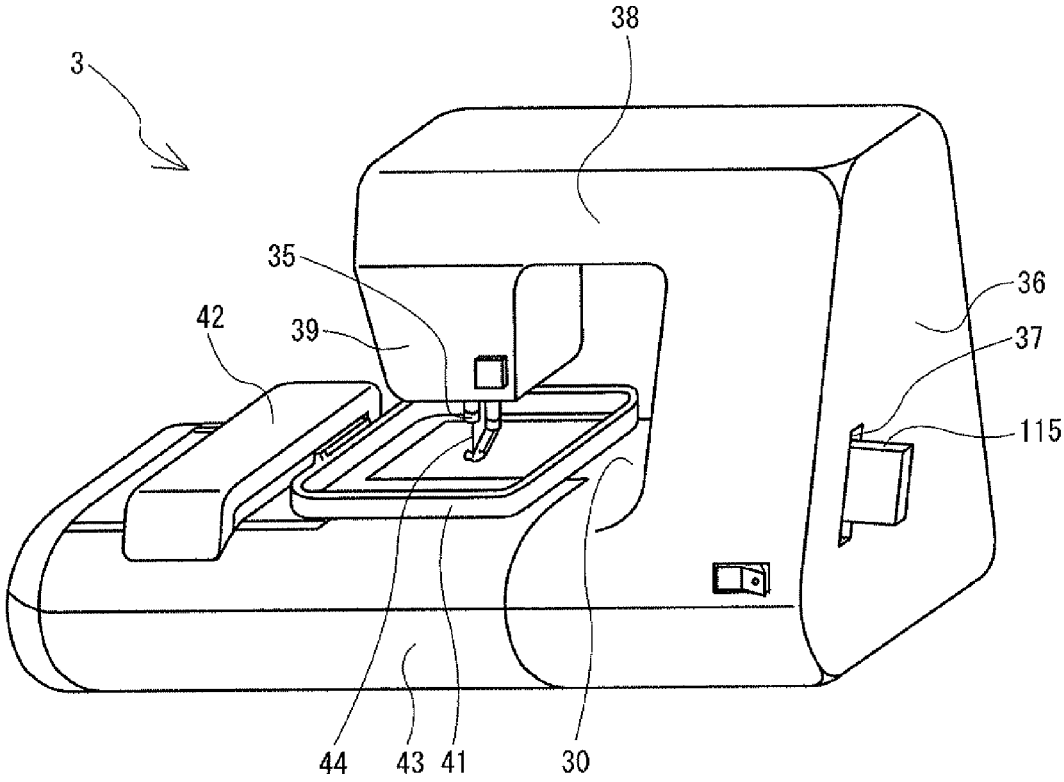
FIG. 3 is an external view of an embroidery sewing machine.

Next, the embroidery sewing machine 3 will be briefly explained with reference to FIG. 3. The embroidery sewing machine 3 sews the embroidery pattern based on the embroidery data generated by the embroidery data generating apparatus 1. As shown in FIG. 3, the embroidery sewing machine 3 has a sewing machine bed 30, a pillar 36, an arm 38, and a head 39. The long dimension of the sewing machine bed 30 runs left to right in relation to a user. The pillar 36 is provided such that it rises upward from the right end of the sewing machine bed 30. The arm 38 extends to the left from the upper portion of the pillar 36. The head 39 is joined to the left end of the arm 38. An embroidery frame 41 is disposed above the sewing machine bed 30 and holds a work cloth (not shown in the drawings) on which embroidery will be performed. A Y direction drive portion 42 and an X direction drive mechanism (not shown in the drawings) move the embroidery frame 41 to a specified position that is indicated by an XY coordinate system (hereinafter simply called an embroidery coordinate system) that is specific to the embroidery sewing machine 3. The X direction drive mechanism is accommodated within a main body case 43. A needle bar 35 to which a stitching needle 44 is attached and a shuttle mechanism (not shown in the drawings) are driven in conjunction with the moving of the embroidery frame 41. In this manner, the embroidery pattern is formed on the work cloth. The Y direction drive portion 32, the X direction drive mechanism, and the needle bar 35 and the like are controlled by a control unit (not shown in the drawings) including a microcomputer or the like that is built into the embroidery sewing machine 3.

A memory card slot 37 is provided on a side face of the pillar 36 of the embroidery sewing machine 3. The memory card 115 may be inserted into and removed from the memory card slot 37. For example, the embroidery data generated by the embroidery data generating apparatus 1 may be stored in the memory card 115 through the memory card connector 23. The memory card 115 is then inserted into the memory card slot 37, the embroidery data stored in the memory card 115 is read, and the embroidery data is stored in the embroidery sewing machine 3. A control unit (not shown in the drawings) of the embroidery sewing machine 3 automatically controls embroidery operations of the above-described elements, based on the embroidery data that is supplied from the memory card 115. This makes it possible to use the embroidery sewing machine 3 to sew the embroidery pattern based on the embroidery data that is generated by the embroidery data generating apparatus 1.

Figure 4:
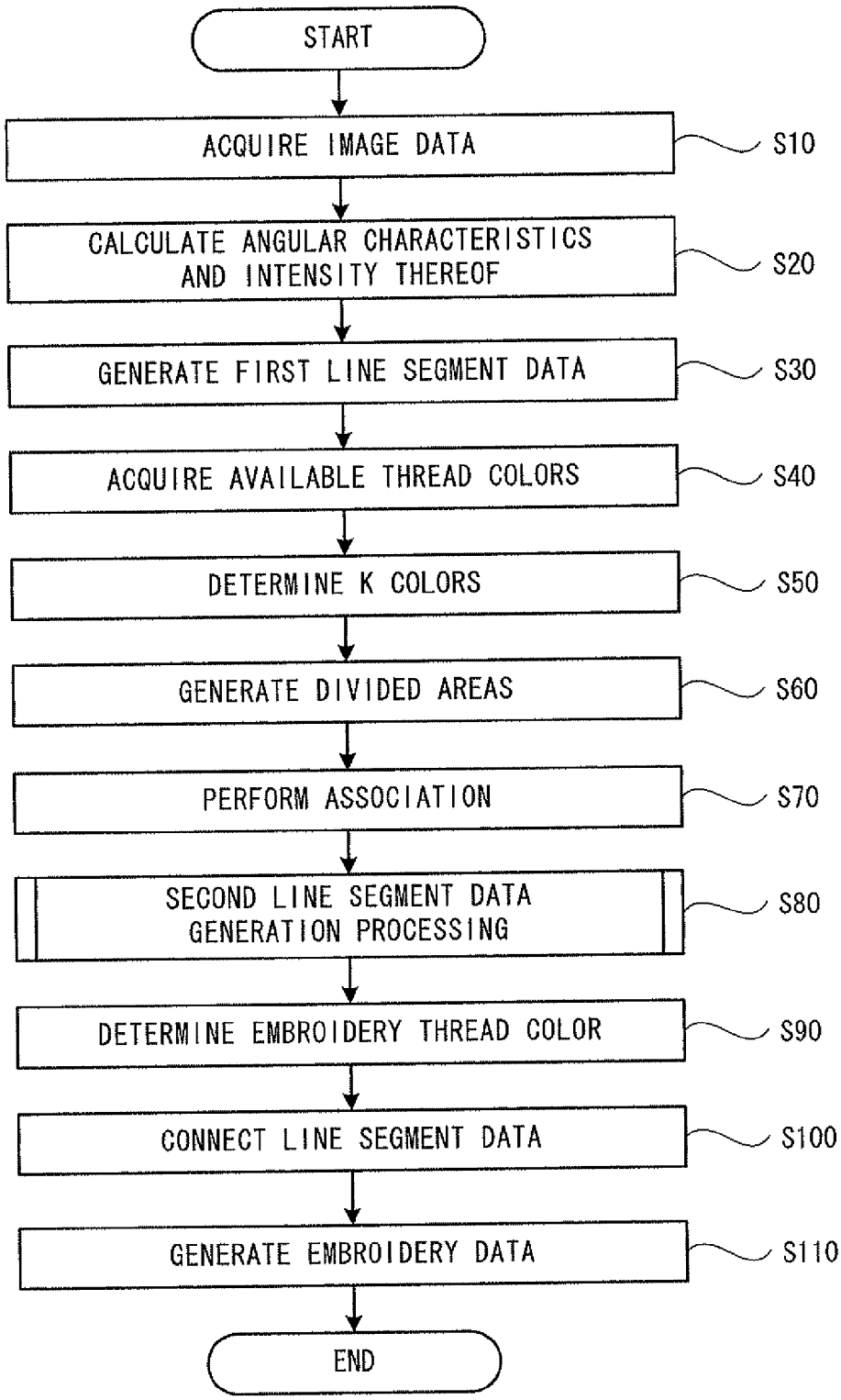
FIG. 4 is a flowchart of main processing.

Next, a processing procedure in which the embroidery data generating apparatus 1 according to the first embodiment generates the embroidery data based on image data will be explained with reference to FIG. 4 to FIG. 14. Main processing of the embroidery data generation, as shown in FIG. 4, is executed by the CPU 11 in accordance with the embroidery data generating program stored in the program storage area 161 of the HDD 15. For ease of explanation, an explanation will be simplified of processes similar to known technology. For example, Japanese Laid-Open Patent Publication No. 2001-259268 discloses a method that calculates angular characteristic and angular characteristic intensity, the relevant portions of which are herein incorporated by reference. In order to simplify the explanation, pixels and line segments will be exemplified as described below. A plurality of pixels that is provided with an image are schematically depicted as squares in a grid layout. Each grid square, which represents one pixel, is expressed as a regular square of which one side is one unit. For example, three units correspond to one millimeter. Positions of the pixels on the image are represented using coordinates of an image coordinate system expressed by (X, Y). (X, Y)=(N, M) indicates a pixel positioned in column N and row M. A virtual arrangement of a first line segment, which represents pixels, is depicted overlapping with pixels represented by the squares of the grid. The first line segment is depicted with a length that is different to a length set in the main processing. A size of a pixel is considered to be sufficiently small in comparison to the length of the first line segment.

Figure 5:
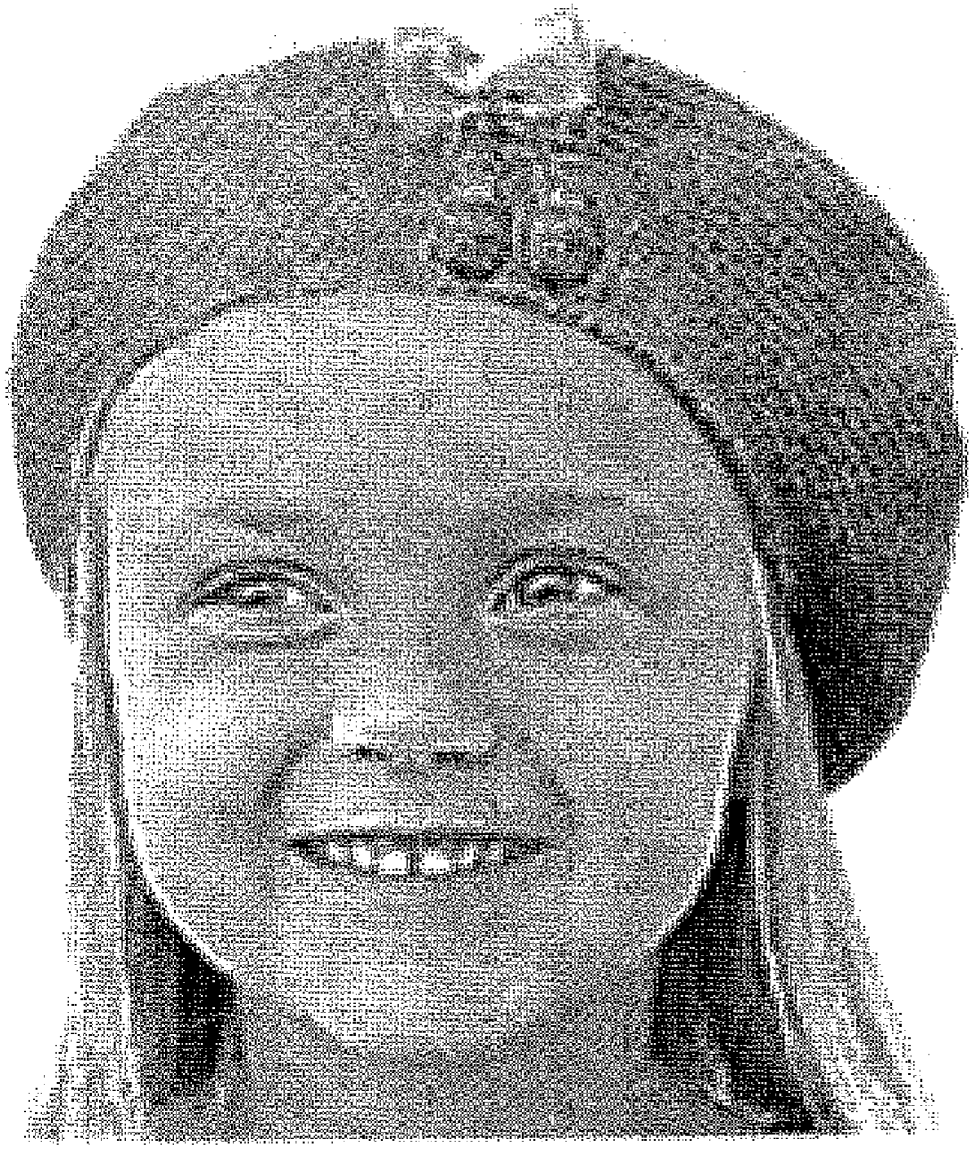
FIG. 5 is an image of a first specific example obtained when performing the main processing shown in FIG. 4.

As shown in FIG. 4, in the main processing of the first embodiment, first, image data is acquired, and the acquired image data is stored in the image data storage area 151 (Step S10). The image data acquired at Step S10 is data representing an image that is to be used as a subject for generating the embroidery data. The image data includes pixel data pieces corresponding, respectively, to a plurality of pixels that are arranged on a two dimensional matrix forming the image. The image data may be acquired by any method. For example, the image data may be acquired by scanning the image using the image scanner 25. Alternatively, a file stored on an external storage medium, such as a memory card etc., may be acquired as the image data. As a first specific example, a case is assumed in which, at Step S10, image data of a photograph shown in FIG. 5 is acquired. FIG. 5 is shown in black and white, but it is a color photograph of a girl with blond hair wearing a blue hat in reality.

Next, the angular characteristic and the angular characteristic intensity of a first target pixel of the image represented by the image data acquired at Step S10 (hereinafter simply referred to as the "original image") are calculated. The calculated angular characteristic and the angular characteristic intensity are stored as angular characteristic data in the angular characteristic data storage area 152 (Step S20). The first target pixel is a single pixel selected from among the pixels of the original image. A plurality of adjacent pixels as a whole may be selected as the first target pixel. The angular characteristic indicates a direction of change in brightness of the first target pixel. The angular characteristic intensity indicates a magnitude of the change in brightness of the first target pixel. Various known methods can be adopted as a method of calculating the angular characteristic and the intensity thereof, and a detailed explanation is therefore omitted here. At Step S20, all the pixels included in the original image are sequentially acquired as the first target pixel, and the angular characteristic and the angular characteristic intensity of the acquired target pixel are calculated.

Figure 6:
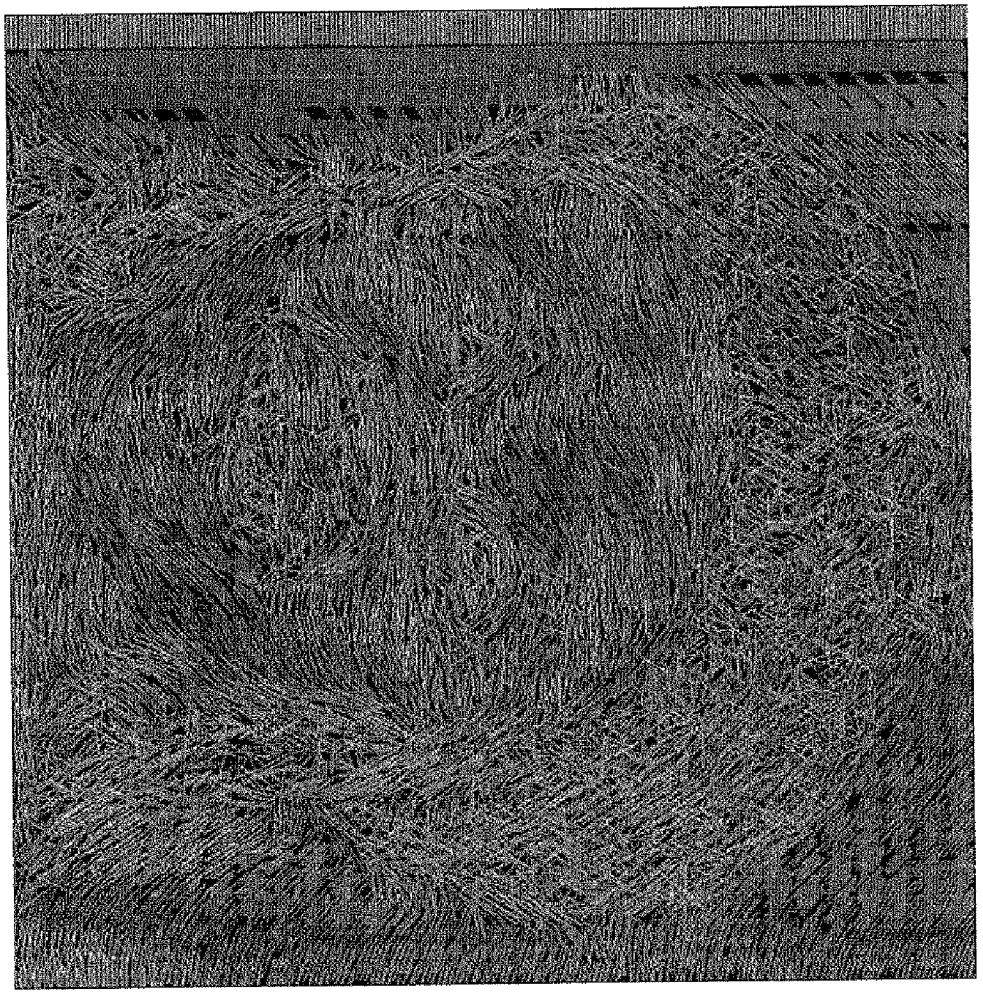
FIG. 6 is an explanatory diagram that shows first line segments by changing color of line segments depending on an angle (tilt) of the first line segments, the first line segments being represented by first line segment data that is generated, in the main processing shown in FIG. 4, based on image data representing the image shown in FIG. 5.
Figure 25:
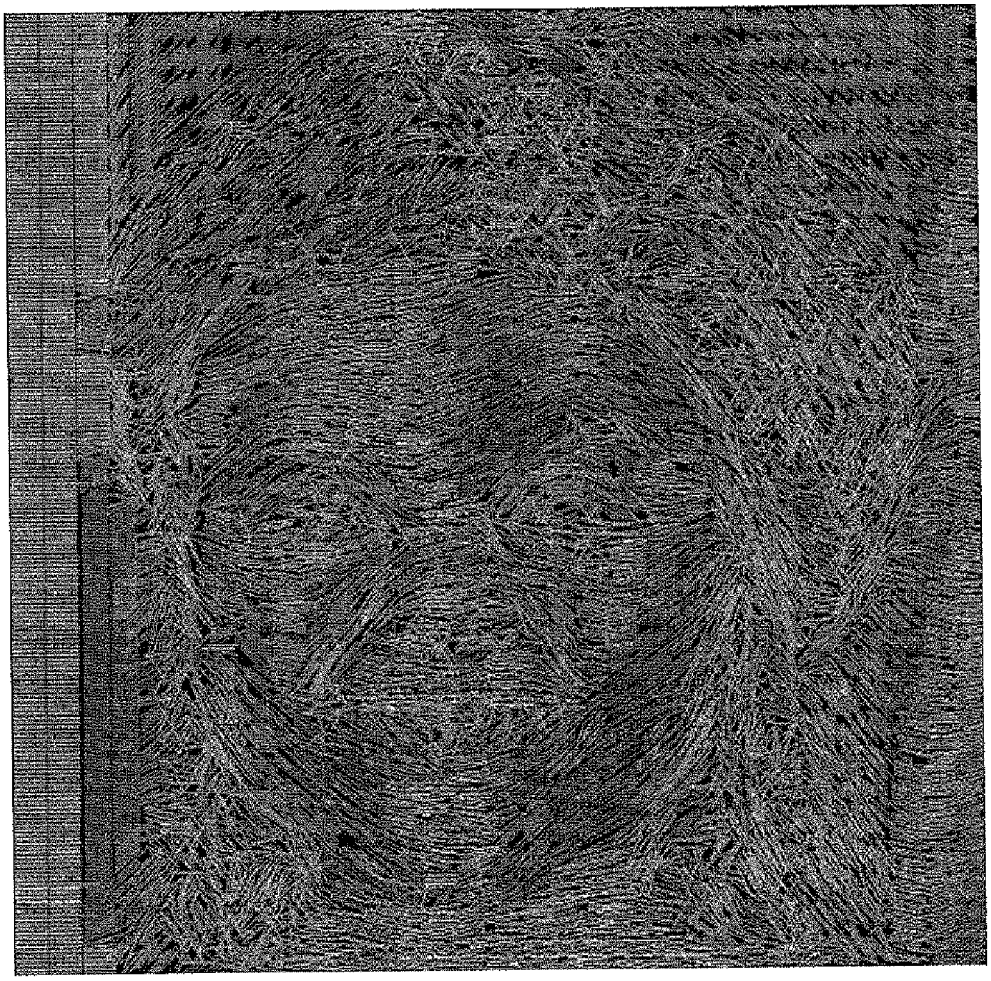
FIG. 25 is an explanatory diagram that shows the first line segments of the first specific example by changing color of the line segments depending on the angle (tilt) of the first line segments, the first line segments being represented by the first line segment data after the deletion processing is performed.

Next, based on the angular characteristic data calculated at Step S20, first line segment data is generated such that as much as possible of the whole image can be covered with first line segments. The generated first line segment data is then stored in the line segment data storage area 153 (Step S30). Each first line segment data piece represents the first line segment. The first line segment is represented by an angular component and a length component that are set to the first target pixel. The first line segment is centered on the first target pixel. More specifically, the angular characteristic of the first target pixel calculated at Step S20 is set as the angular component of the first line segment data. Further, a fixed value that is set in advance or a value that is input by a user is set as the length component of the first line segment data. It is preferable for the length component of the first line segment data to be determined while taking into account a minimum unit of a length of a stitch that can be sewn (hereinafter referred to as a "sewable stitch"), and is set, for example, as three millimeters. In the present embodiment, the first line segment represented by the first line segment data overlaps with a plurality of pixels that include the first target pixel. Various known methods can be used as a method to generate the first line segment data, and a detailed explanation is therefore omitted here. For example, at Step S30, the first line segment data is generated for pixels whose angular characteristic intensity is equal to or greater than a predetermined value, and the first line segment data is not generated for pixels whose angular characteristic intensity is smaller than the predetermined value. In other words, the pixels for which the first line segment data is generated are some of the pixels included in the image. In the first specific example, the first line segment data pieces are generated that represent line segments shown in FIG. 6. In FIG. 6 and FIG. 25 (which will be described later), line segments are changed in color depending on an angle (tilt) of the line segments.

Next, available thread colors are acquired, and the acquired available thread colors are stored in the available thread color storage area 157 (Step S40). The available thread colors are colors of the threads that are planned to be used when sewing an embroidery pattern using the embroidery sewing machine 3 in accordance with the embroidery data. The embroidery data is generated by the embroidery data generating apparatus 1 based on the image data acquired at Step S10. In the present embodiment, from among thread colors that can be used, J thread colors (J is the number of thread colors) that are selected based on the pixel data is acquired as the available thread colors. The thread colors that can be used are colors of threads that can be prepared by the user as the thread colors to be used in sewing. The thread colors that can be used are represented by fixed values set in advance or by values input by the user. For example, let us assume that thirty colors are set as the thread colors that can be used. At Step S40, first, the colors of the original image are reduced to J colors, J being the number of the available thread colors. A median cut algorithm can be used, for example, as a color reduction method. In this processing, for example, the colors of the original image shown in FIG. 5 are reduced to ten colors. Next, from among the thirty thread colors that can be used, the thread colors close to each of the ten colors are acquired as the available thread colors. When the available thread colors are determined in this way, appropriate available thread colors can be determined from among the thread colors that can be used, taking into account the number of times to replace threads and the colors of the image. The available thread colors may also be determined as fixed values that are set in advance or as values input by the user.

Figure 7:
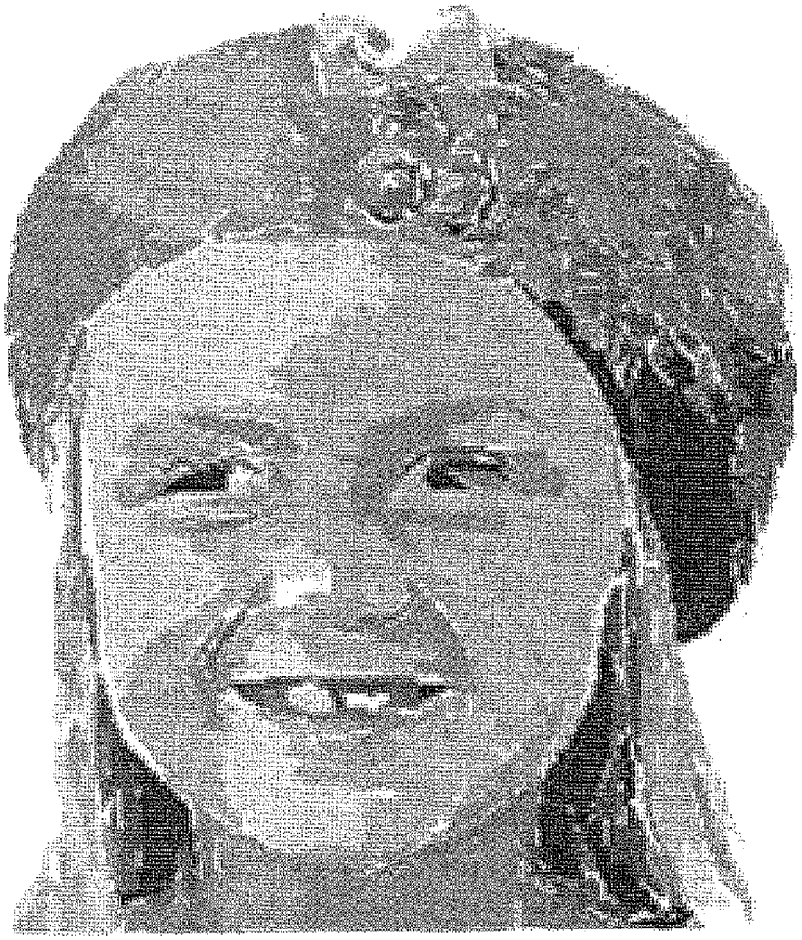
FIG. 7 is an explanatory diagram that illustrates divided areas that are generated in the main processing shown in FIG. 4 by dividing into areas the image shown in FIG. 5.

Next, based on the pixel data, K colors (K is the number of colors) that are colors used to divide up the original image are determined, and the determined K colors are stored in the RAM 12 (Step S50). The K colors are determined, for example, by the median cut method. The K colors are used when dividing up areas of the original image based on the pixel data. The number of colors K is a fixed value that is set in advance or a value input by the user. Then, the areas of the original image are divided up based on the pixel data, and converted image data is stored in the divided area storage area 154 (Step S60). More specifically, each color that is set for each of the pixels is associated with a closest color of the K colors set at Step S50. When this results in very small areas, the very small areas are integrated with the other divided areas by noise reduction, for example. For ease of explanation, in the first embodiment, areas of the same color as a result of color reduction are assumed to be the same divided area. In the processing at Step S60, in the first specific example, the original image shown in FIG. 5 is divided up into areas as shown in FIG. 7. Next, the divided areas generated at Step S60 are associated with the pixels included in each of the divided areas, and associated relationships of the pixels and the divided areas are stored in the association storage area 155 (Step S70).

Next, second line segment data generation processing is performed (Step S80). In the second line segment data generation processing, processing is performed to generate first expanded data based on the first line segment data generated at Step S30, and then to generate second line segment data based on the generated first expanded data. The expanded data is data that associates, based on the first line segment data, pixels overlapping with the first line segments represented by the first line segment data with angle data that represents extension directions of the first line segments. In the present embodiment, two types of expanded data are generated as the expanded data, namely, the first expanded data and the second expanded data. The second line segment data generation processing will be explained in detail with reference to FIG. 8.

Figure 8:
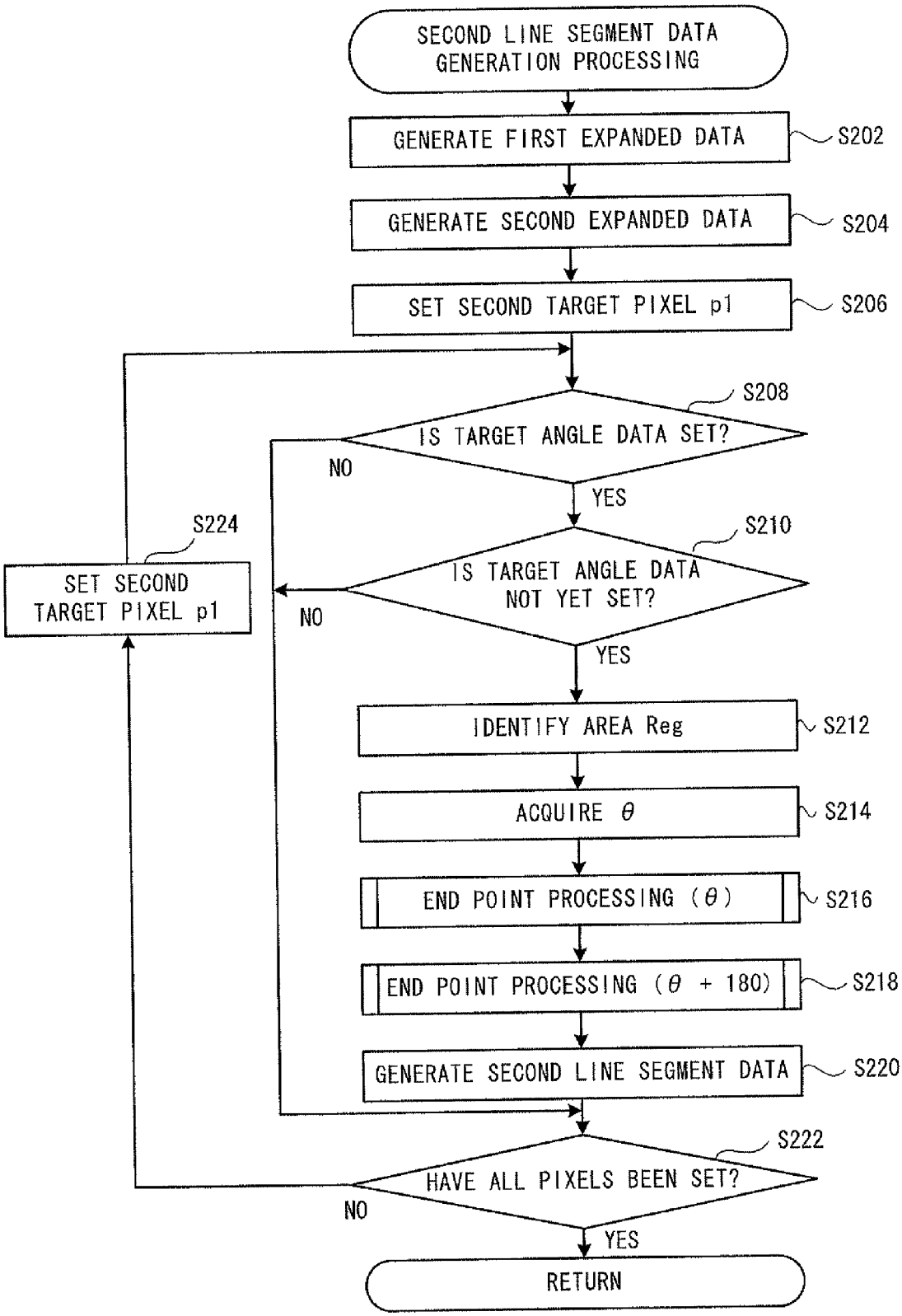
FIG. 8 is a flowchart of second line segment data generation processing that is performed in the main processing shown in FIG. 4.

As shown in FIG. 8, in the second line segment data generation processing, first the first expanded data is generated and the generated first expanded data is stored in the expanded data storage area 156 (Step S202). At Step S202, the pixels are identified that overlap with the first line segments represented by the first line segment data pieces generated at Step S30 in FIG. 4, and the angle data pieces, which indicate angles of the first line segments (tilts on the image coordinates) are associated with the pixels that overlap with the first line segments. As in the present embodiment, when a value larger than the size of a single pixel is set as the length component of the first line segment data pieces, the first line segment also overlaps with pixels other than the first target pixel. By the processing at Step S202, all of the pixels that overlap with the first line segment are associated with the first line segment data piece.

Figure 9:
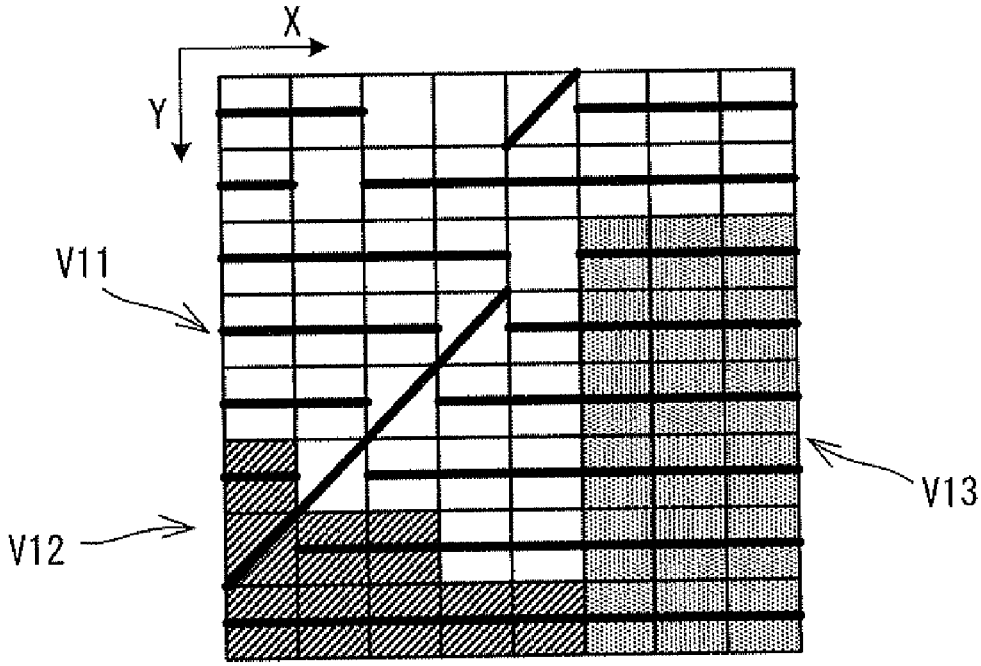
FIG. 9 is an explanatory diagram that schematically shows, of a second specific example, pixels forming an image, divided areas in which each of the pixels is included, and positions on the image of first line segments represented by the first line segment data generated in the main processing shown in FIG. 4.
Figure 10:
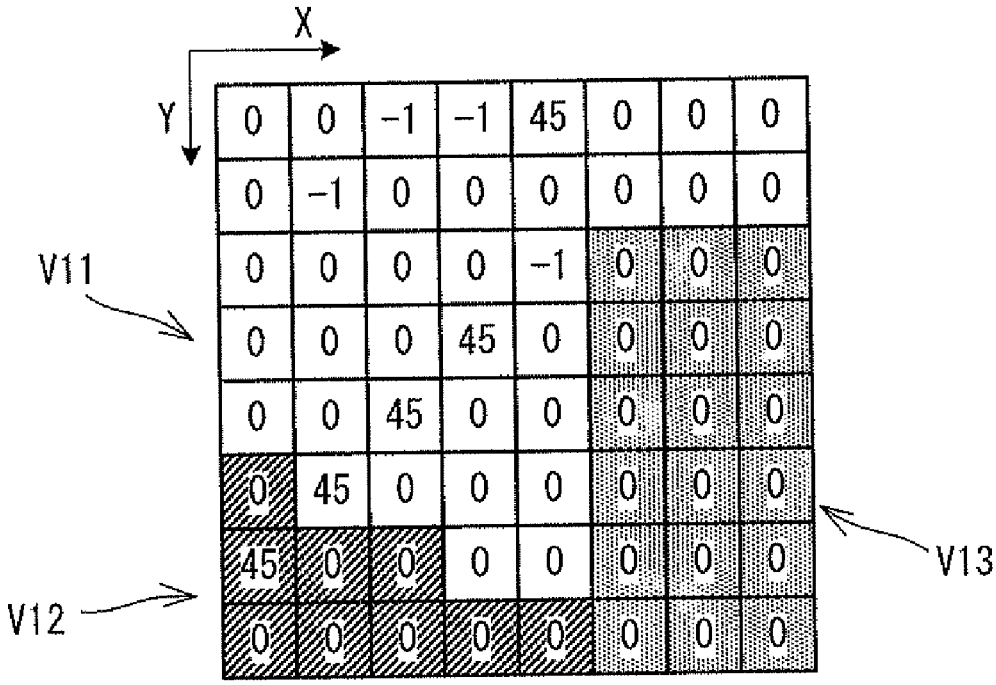
FIG. 10 is an explanatory diagram of first expanded data of the second specific example.

With respect to Step S202, a case is assumed in which positional relationships between the first line segments and the pixels are as shown in FIG. 9. In FIG. 9, for ease of explanation, the length components of each of the first line segments do not represent the minimum unit of length of the sewable stitch. In a second specific example, at Step S202, the first expanded data is generated as shown in FIG. 10. Numbers associated with the pixels represented by the grid squares in FIG. 10 are the angle data. The angle data runs from 0 to 180 degrees, and is represented by an anti-clockwise angle from a plus direction of the X axis of the image coordinate system to the first line segment The extension direction of the first line segment that overlaps with the pixels associated with the angle data is, as seen from a second target pixel p1, a direction indicated by an angle indicated by the angle data and an angle which is 180 degrees different to the angle indicated by the angle data. The second target pixel p1 is a pixel that is a target pixel among the pixels included in the first expanded data. −1 is set for pixels that do not overlap with any of the first line segments, −1 indicating that the angle data is not yet set. Further, based on the divided areas generated at Step S60 in FIG. 4, data representing one of divided areas V11, V12 and V13, in which a pixel is included, is allocated for each of the pixels to the first expanded data shown in FIG. 10.

Next, the second expanded data is generated, and the generated second expanded data is stored in the expanded data storage area 156 (Step S204). The second expanded data is expanded data used in processing to identify both ends of a second line segment, based on the first expanded data. The second expanded data generated at Step S204 is the second expanded data in an initial state, and is data in which −1 is set as the angle data of each of the pixels included in the image, as shown in FIG. 11. In the present embodiment, when updating the expanded data, the second expanded data is updated. The second expanded data is updated by end point processing which will be explained later. Next, the first pixel in a call order is set as the second target pixel p1, and the set second target pixel p1 is stored in the RAM 12 (Step S206). In the present embodiment, the call order of the second target pixels p1 is set to be an order from left to right and from top to bottom, in accordance with a position in the image. In the second specific example, at Step S206, the pixel on the top left shown in FIG. 10 (X, Y)=(1, 1) is set as the second target pixel p1

Then, the first expanded data of the expanded data storage area 156 is referred to, and it is determined whether the angle data corresponding to the second target pixel p1 (hereinafter referred to as "target angle data") has been set (Step S208). At Step S208, when, in the first expanded data, the data corresponding to the second target pixel p1 is −1, it is determined that the target angle data has not been set. When, in the first expanded data, the data corresponding to the second target pixel p1 is zero or above, it is determined that the target angle data has been set. When the target angle data has not been set (no at Step S208), processing at Step S222 is performed, which will be explained later.

In the second specific example, since zero is associated as the angle data with the pixel (X, Y)=(1, 1) as shown in FIG. 10 (yes at Step S208), the second expanded data is referred to and it is determined whether the target angle data has been set in the second expanded data (Step S210). At Step S210, similarly to Step S208, when, in the second expanded data, the data corresponding to the second target pixel p1 is −1, it is determined that the target angle data has not been set (yes at Step S210). When, in the second expanded data, the data corresponding to the second target pixel p1 is zero or above, it is determined that the target angle data has been set (no at Step S210). In this case, the processing at Step S222 is performed, which will be explained later.

In the second specific example, −1 is associated with the pixel (X, Y)=(1, 1) in the second expanded data shown in FIG. 11 (yes at Step S210). Therefore, the first expanded data is referred to, an area Reg of the second target pixel p1 is identified, and the identified area Reg is stored in the RAM 12 (Step S212). In the second specific example, V11 is identified as the area Reg of the pixel (X, Y)=(1, 1). Next, an angle θ of the second target pixel p1 is acquired, and the acquired angle θ is stored in the RAM 12 (Step S214). The angle θ of the second target pixel p1 is represented by the target angle data. In the second specific example, zero degrees is acquired as the angle θ.

Next, the end point processing on the angle θ acquired at Step S214 (Step S216) and end point processing on the angle θ+180 degrees (Step S218) are performed. By the end point processing, the pixel that is in the extension direction when seen from the second target pixel p1, and that is associated with the angle data indicating the same angle as the angle θ, is identified as the extension direction pixel. By the end point processing for the angle θ (Step S216) and the end point processing for the angle θ+180 degrees (Step S218), the pixels are identified that overlap with the end points of the second line segment generated based on the first line segment that overlaps with the second target pixel p1. The angle θ and the angle θ+180 degrees indicate the extension direction of the first line segment that overlaps with the second target pixel p1. The end point processing for the angle θ (Step S216) and the end point processing for the angle θ+180 degrees (Step S218) are basically the similar processing, and the end point processing for the angle θ (Step S216) is used as an example in explaining the end point processing.

Figure 12:
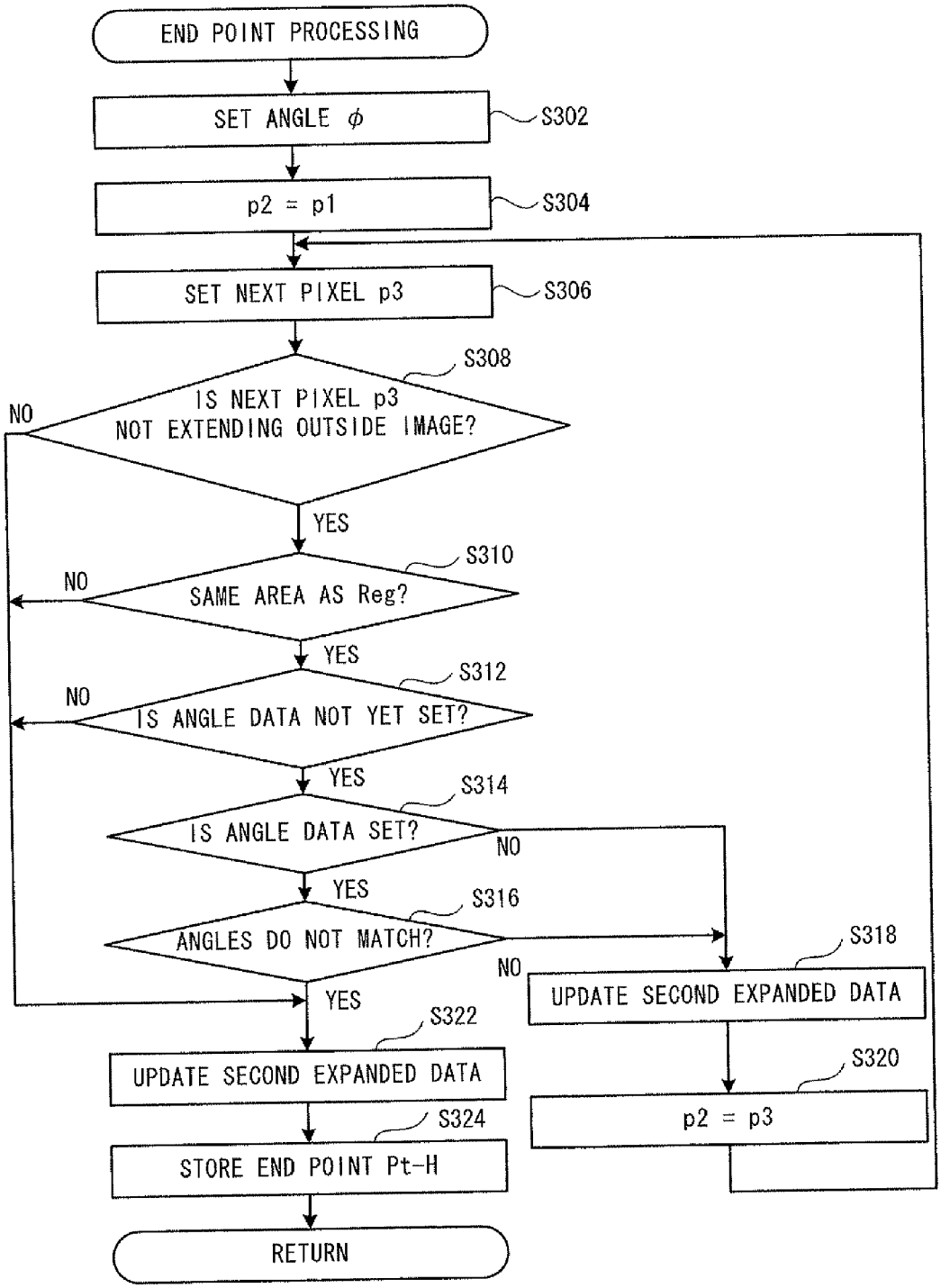
FIG. 12 is a flowchart of end point processing that is performed in the second line segment data generation processing shown in FIG. 8.

As shown in FIG. 12, in the end point processing, first, an angle ϕ is set and the set angle ϕ is stored in the RAM 12 (Step S302). In the end point processing performed at Step S216 in FIG. 8, the angle θ is set as the angle ϕ. In the end point processing performed at Step S218, the angle θ+180 degrees is set as the angle ϕ. Next, the second target pixel p1 is set as a current pixel p2, and the set current pixel p2 is stored in the RAM 12 (Step S304). Following this, a next pixel p3 is set, and the set next pixel p3 is stored in the RAM 12 (Step S306). The next pixel p3 is a pixel in a position one pixel moved in a direction of the angle ϕ (set at Step S302) from the current pixel p2. At Step S306, the pixels in the direction indicated by the angle ϕ as seen from the second target pixel p1 are read in ascending order of distance from the second target pixel p1. A method to identify an n-th pixel that is in the direction of the angle ϕ as seen from the second target pixel p1 may be established as appropriate in accordance with the second target pixel p1 and the angle ϕ. For example, the above-mentioned n-th pixel may be identified in accordance with which pixel includes a coordinate in the image coordinate system when moving by a F number of pixels in the direction of the angle ϕ from the second target pixel p1. More specifically, when the angle ϕ is set as the angle θ, a movement amount Ma from the second target pixel p1 to the above-mentioned F-th pixel may be established in accordance with the angle ϕ as described below. When the angle ϕ is at least zero and less than 45 degrees, the movement amount Ma is (xF, −yF tan ϕ). When the angle ϕ is at least 45 degrees and less than 90 degrees, the movement amount Ma is (xF/tan ϕ, −yF). When the angle ϕ is at least 90 degrees and less than 135 degrees, the movement amount Ma is (xF/tan ϕ, −yF). When the angle is at least 135 degrees and equal to or less than 180 degrees, the movement amount Ma is (−xF, yF tan ϕ). Note that x=y=1 (unit). Even when the angle θ+180 degrees is set as the angle ϕ, the movement amount Ma may be set in a similar manner. In the second specific example, a pixel (X, Y)=(2, 1), which is in a position one pixel moved from the current pixel p2 (X, Y)=(1, 1) in the direction of an angle of zero degrees, is set as the next pixel p3.

Next, it is determined whether the next pixel p3 is extending outside the image (Step S308). In the second specific example, the pixel (X, Y)=(2, 1) is not extending outside the image (yes at Step S308) and it is therefore determined whether the next pixel p3 is a pixel of the same area as the area Reg set at Step S212 in FIG. 8 (Step S310). As the pixel (X, Y)=(2, 1) of the second specific example is a pixel of the same area as the area V11 identified at Step S212 (yes at Step S310), the second expanded data is referred to, and it is determined whether the angle data corresponding to the next pixel p3 is set in the second expanded data (Step S312). At Step S312, the determination is made in a similar manner to the processing at Step S210 in FIG. 8. As shown in FIG. 11, as the angle data for the pixel (X, Y)=(2, 1) of the second specific example is not set in the second expanded data (yes at Step S312), the first expanded data is referred to and it is determined whether the angle data of the next pixel p3 is set in the first expanded data (Step S314).

Step S314 is processing that detects, as a detected pixel, a unset pixel that is a pixel which is not associated with the angle data in the first expanded data. The processing at Step S314 is similar to that at Step S208 in FIG. 8. For the pixel (X, Y)=(2, 1) of the second specific example, the angle data is set in the first expanded data (yes at Step S314). As a result, it is determined whether the angle indicated by the angle data associated with the next pixel p3 in the first expanded data matches the angle θ acquired at Step S214 in FIG. 8 (the angle indicated by the target angle data) (Step S316). As shown in FIG. 10, in the first expanded data, the angle indicated by the angle data associated with the pixel (X, Y)=(2, 1) of the second specific example is zero degrees, and is the same as the angle of zero degrees acquired at Step S214 (no at Step S316). Thus, the angle data representing the angle θ acquired at Step S214 in FIG. 8 is set as the angle data corresponding to the current pixel p2 in the second expanded data, and the second expanded data is updated (Step S318). The updated second expanded data is stored in the expanded data storage area 156. Next, the next pixel p3 is set as the current pixel p2 and the newly set current pixel p2 is stored in the RAM 12 (Step S320). Then, the processing returns to Step S306.

When the current pixel p2 is the pixel (X, Y)=(2, 1) of the second specific example, at Step S314, it is determined that the angle data of the next pixel p3 is not set in the first expanded data (no at Step S314) and the processing at Step S318 is performed. In this case, Step S318 is processing to set the angle data for the detected pixel detected by the processing at Step S314. More specifically, the angle data representing the angle θ acquired at Step S214 in FIG. 8 is set as the angle data of the detected pixel in the second expanded data (Step S318). The angle data representing the angle θ is the same as the angle data associated with the pixel read as the current pixel p2 immediately preceding the detected pixel. Thus, in the present embodiment, the angle data of the detected pixel is set based on the angle data associated with the pixel that is within a distance of √2 units (a length of a diagonal line of the pixel represented by the square grid of which one side is 1 unit) from the detected pixel.

When the current pixel p2 is a pixel (X, Y)=(4, 1) of the second specific example, at Step S316, it is determined that the angles do not match (yes at Step S316). In this case, processing is performed that is similar to that at Step S318 (Step S322). In the second specific example, when the second target pixel p1 is the pixel (X, Y)=(1, 1), the second expanded data is updated as shown in FIG. 13 by the processing at Step S322. Next, coordinates of the current pixel p2 are stored in the RAM 12 as one of the end points Pt-H (H=1, 2) (Step S324). In the second specific example, (X, Y)=(4, 1) is stored as one of the end points, namely as an end point Pt-1, in the RAM 12. In the end point processing performed at Step S218 in FIG. 8, an end point Pt-2 is stored at Step S324. The above-described processing at Step S322 is performed when, at Step S308, the next pixel p3 is extending outside the image (no at Step S308), when, at Step S310, the next pixel p3 is not the pixel within the area Reg (no at Step S310), and when, at Step S312, the next pixel p3 is set in the second expanded data (no at Step S312).

In the second specific example, in the end point processing performed at Step S218, when (X, Y)=(1, 1) is set as the current pixel p2, it is determined at Step S308 that the next pixel p3 (X, Y)=(0, 1) is extending outside the image (no at Step S308) and (X, Y)=(1, 1) is stored in the RAM 12 as the end point Pt-2 (S324). After Step S324, the end point processing is ended, and the processing returns to the second line segment data generation processing shown in FIG. 8.

After Step S218 in FIG. 8, the second line segment data is generated that represents the second line segment joining the end point Pt-1 set at Step S216 and the end point Pt-2 set at Step S218, and the generated second line segment data is stored in the line segment data storage area 153 (Step S220). In the second specific example, the second line segment data is generated that represents the second line segment joining the end point Pt-1 (X, Y)=(4, 1) set at Step S216 and the end point Pt-2 (X, Y)=(1, 1) set at Step S218. Pixels that overlap with the second line segment represented by the second line segment data are the second target pixel p1 and the extension direction pixels. The extension direction pixels are pixels that are in the extension direction indicated by the target angle data, as seen from the second target pixel p1, and are associated with the angle data that is the same as the target angle data. A pixel area formed by the extension direction pixels that overlap with the second line segment and by the second target pixel p1 is a single continuous area.

Figure 14:
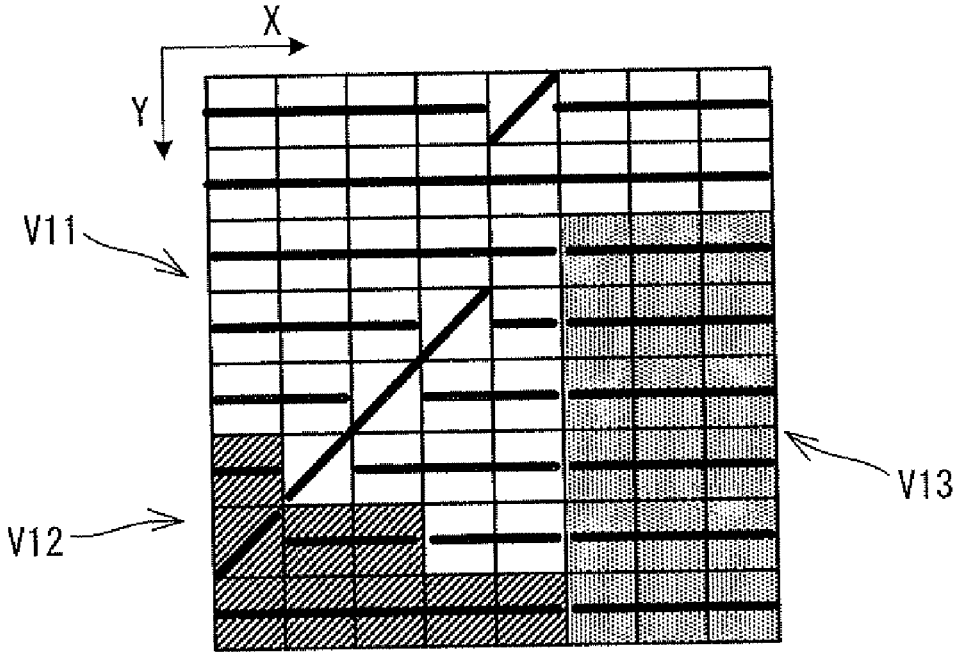
FIG. 14 is an explanatory diagram that shows, of the second specific example, associations between pixels forming an image, divided areas in which each of the pixels is included, and positions on the image of second line segments represented by second line segment data generated in the main processing shown in FIG. 4.

Following the above, it is determined whether all of the pixels of the original image have been set as the second target pixel p1 (Step S222). When there is at least one pixel that has not been set (no at Step S222), the pixel next in the order is set as the second target pixel p1 and the newly set second target pixel p1 is stored in the RAM 12 (Step S224). The processing then returns to Step S208. When all of the pixels have been set as the second target pixel p1 (yes at Step S222), the second line segment data generation processing is ended, and the processing returns to the main processing shown in FIG. 4. In the second specific example, the second line segment data pieces representing the second line segments shown in FIG. 14 are generated by the second line segment data generation processing. In FIG. 14, virtual arrangements of second line segments are depicted overlapping with pixels represented by the squares of the grid. In FIG. 14, all of the pixels overlap with one of the second line segments.

Following Step S80, the embroidery thread color is determined with respect to the second line segment data generated at Step S80, and associations between the second line segment data and the embroidery thread color are stored in the embroidery thread color storage area 159 (Step S90). A known method may be used to determine the embroidery thread color associated with the second line segment data. More specifically, first, the line segment data storage area 153 is referred to and the second line segment data pieces are sequentially read out. Next, the image data storage area 151 is referred to and, from among the available thread colors acquired at Step S40, the embroidery thread colors to be allocated to the second line segment data pieces are determined based on the pixel data pieces corresponding to the read out second line segment data pieces respectively.

Next, the line segment data storage area 153 and the embroidery thread color storage area 159 are referred to and connecting line segment data is generated, the generated connecting line segment data is stored in the line segment data storage area 153 (Step S100). The connecting line segment data piece is a data piece indicating a line segment (connecting line segment) that connects a plurality of the second line segments indicated by the second line segment data pieces to which the same embroidery thread color is allocated. A variety of known methods may be adopted as a method to generate the connecting line segment data. For example, let us assume that one end of a No. k second line segment is a starting point and the other end is an ending point. Another second line segment is searched that has an end closest to the ending point of the No. k second line segment. The second line segment that has been found in the search is set as the No. k+1 second line segment. Then, the connecting line segment data piece for the connecting line segment that connects the No. k second line segment and the No. k+1 second line segment is generated. The above-described processing may be performed with respect to all the second line segment data pieces associated with the same thread color, and a connecting sequence may be set such that the second line segments indicated by the second line segment data pieces are mutually connected by adjacent ends. The embroidery thread color allocated to the connecting line segment data is the embroidery thread color allocated to the second line segment data piece being connected.

Next, based on the second line segment data and the connecting line segment data stored in the line segment data storage area 153, and the embroidery thread colors stored in the embroidery thread color storage area 159, the embroidery data is generated and the generated embroidery data is stored in the embroidery data storage area 160 (Step S110). The embroidery data includes a sewing order, thread color data and needle drop point data. A variety of known methods may be adopted as a method to generate the embroidery data. For example, starting points and ending points of the second line segments indicated by the second line segment data pieces for each of the same embroidery thread color are converted into the coordinates of the embroidery coordinate system that represent starting points and ending points of stitches. The starting points and the ending points of the stitches are stored in association with the thread color in the sewing order. Furthermore, connecting line segment data processing is performed on starting points and ending points of the connecting line segments indicated by the connecting line segment data pieces, such that they are respectively converted into starting points and ending points of a running stitch or a jump stitch. The starting point and the ending point of the running stitch or the jump stitch are converted into the coordinates of the embroidery coordinate system, the converted coordinates are stored in association with the embroidery thread color in the sewing order. Following Step S110, the main processing is ended.

As long as two of the first line segments are line segments within the same divided area, the embroidery data generating apparatus 1 of the first embodiment generates the second line segment data representing the second line segment that connects the two of the first line segments in any of a first case and a second case. The first case is when two of the first line segments that extend in the same extension direction partially overlap with each other. The second case is when only the unset pixels are the pixels between two of the first line segments that extend in the same extension direction. In addition, the embroidery data generating apparatus 1 generates the second line segment that overlaps with the unset pixels by further extending the end point of the first line segment in the extension direction of the first line segment. In the second specific example, for example, the line segment extending from (X, Y)=(1, 1) to (X, Y)=(2, 1) is further extended and the second line segment data representing the second line segment extending from (X, Y)=(1, 1) to (X, Y)=(4, 1) is generated, as shown in FIG. 14. Furthermore, in the second specific example, the line segment that extends at a zero degree angle at (X, Y)=(1, 2) and the line segment that extends from (X, Y)=(3, 2) to (X, Y)=(8, 2) are connected, and the second line segment that extends from (X, Y)=(1, 2) to (X, Y)=(8, 2) is generated. As a result, by sewing the embroidery pattern based on the embroidery data generated by the embroidery data generating apparatus 1, it is possible to increase a ratio of continuous (long) stitches. In addition, in a known embroidery data generating apparatus, for example, when two first line segments extending at the same angle (tilt) partially overlap with each other, if connecting line segment data representing a connecting line segment for the two first line segments is generated, the two first line segments are not always reliably connected. Even when the two first line segments are connected by the connecting line segment, as the connecting line segment is formed on the overlapping part of the two first line segments, embroidery data that forms an unnatural embroidery pattern in which stitches are crowded on the overlapping part may be generated. In contrast, in a case in which the two first line segments extending at the same angle partially overlap with each other, the embroidery data generating apparatus 1 can bring together the two first line segments as the single second line segment. As a consequence, in comparison to a case in which a ratio of non-continuous (short) stitches is large, with the embroidery data generating apparatus 1, embroidery data can be acquired that forms a natural embroidery pattern with a beautiful appearance.

The embroidery data generating apparatus 1 generates the second line segment data representing the second line segments that overlap with the unset pixels. Therefore, in an area in which a density of the first line segments is low, the embroidery data generating apparatus 1 can increase a density of the second line segments in comparison with the density of the first line segments. As shown in FIG. 14, in the second specific example, the second line segments are generated such that all of the pixels overlap with one of the second line segments. As a result, by reducing a density difference between an area with a high density of stitches and an area with a low density of stitches, the embroidery data generating apparatus 1 can generate the embroidery data that forms an embroidery pattern with a natural finish, in comparison with a case in which there is a large difference in stitch density.

The second line segment represented by the second line segment data piece indicates direction in color changes of the pixels included in the image. When the second line segment has been generated only based on whether the angles indicated by the angle data piece are the same, second line segment data piece may be generated that represents the second line segment that cuts across different divided areas. In this case, when there is a significant difference in the colors between the different divided areas, the stitches corresponding to the second line segment data piece are significantly different in color to the surrounding stitches, and the finish of the embroidery pattern may deteriorate. Therefore, in an image with significant changes in color, it is preferable to set, as the angle data to be associated with the unset pixels, the angle data that is associated with pixels surrounding the unset pixel that are pixels in the same divided area, as in the first embodiment. The embroidery data generating apparatus 1 reads the pixels in ascending order of distance, from the second target pixel p1 in the direction indicated by the angle $\phi$ as seen from the second target pixel p1, and sets the angle data of the unset pixels inside the same divided area as the second target pixel p1. When considering the pixels that overlap with one of the second line segments represented by the second line segment data generated by the embroidery data generating apparatus 1, each of the pixels is in the same divided area. Thus, by generating the second line segment data by reading in order the extension direction pixels included in the same divided area as the second target pixel p1, the embroidery data generating apparatus 1 can generate the embroidery data to form the embroidery pattern that appropriately expresses changes in color of the whole image by the stitches.

Hereinafter, main processing according to a second embodiment will be explained. The main processing according to the second embodiment is executed by the CPU 11 in accordance with the embroidery data generating program stored in the program storage area 161 of the HDD 15.

Figure 15:
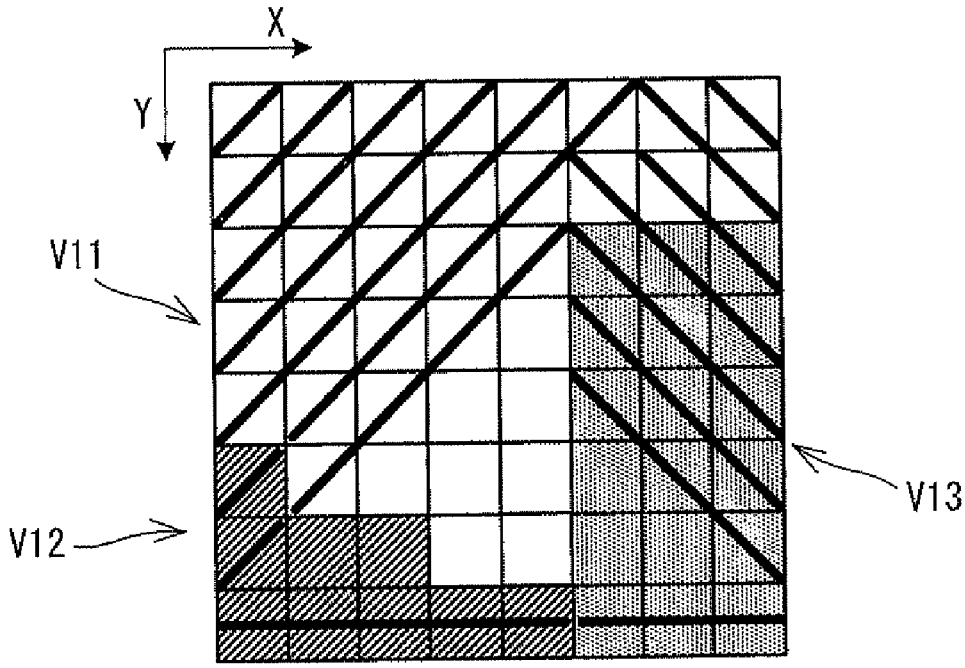
FIG. 15 is an explanatory diagram that shows, of a third specific example, associations between pixels forming an image, divided areas in which each of the pixels is included, and positions on the image of first line segments represented by the first line segment data generated in the main processing shown in FIG. 4.

Although not shown in the drawings, the main processing of the second embodiment is different from the main processing of the first embodiment in that unset pixel processing is performed between Step S80 and Step S90 shown in FIG. 4. An explanation will be omitted of processing that is the same as the main processing of the first embodiment, and the unset pixel processing, which is different to the main processing of the first embodiment, will be explained with reference to FIG. 16. As a third specific example, a case is assumed in which the first line segments represented by the first line segment data generated at Step S30 in FIG. 4 are line segments shown in FIG. 15.

Figure 16:
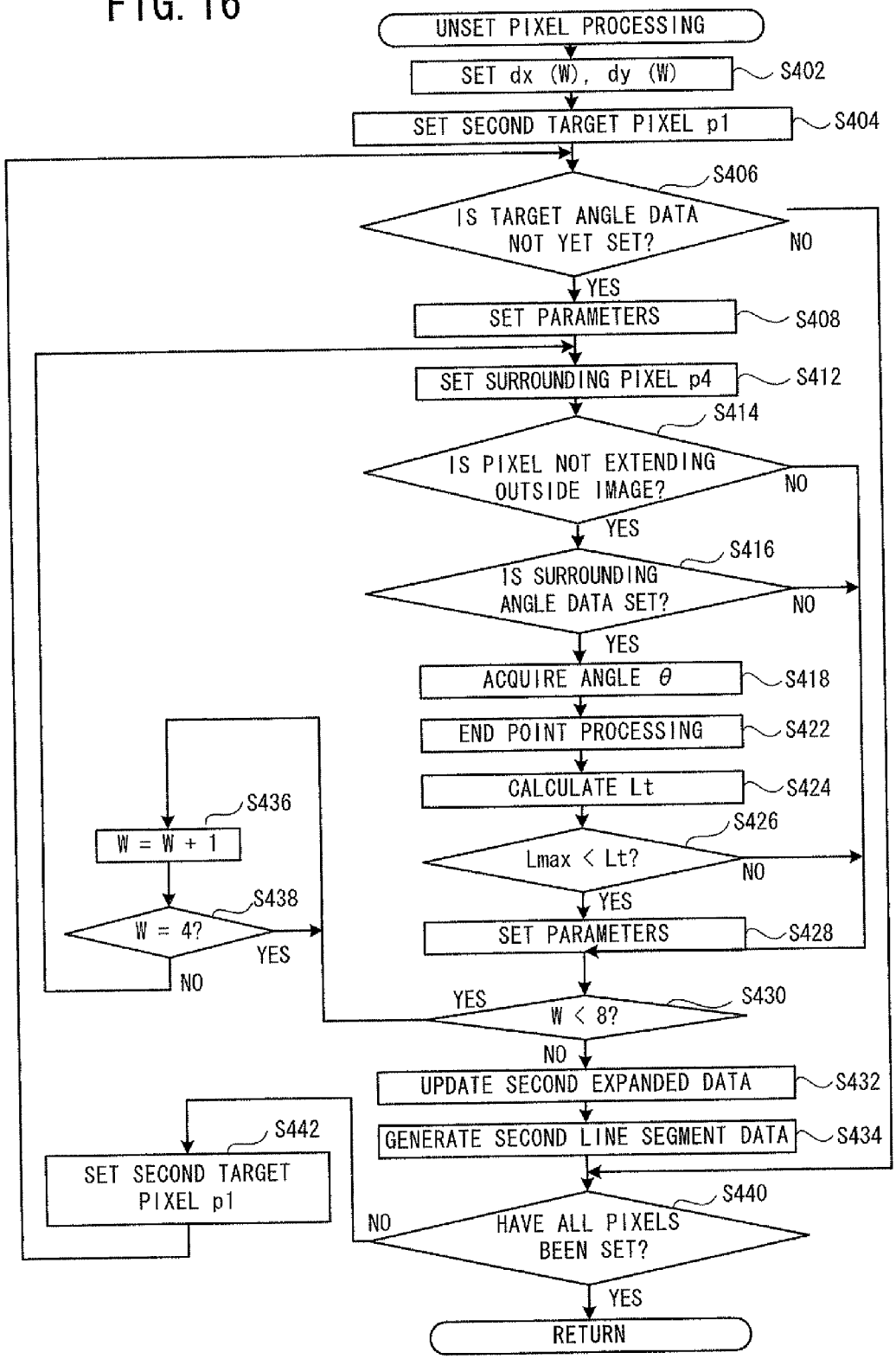
FIG. 16 is a flowchart of unset pixel processing performed in the main processing.
Figure 17:
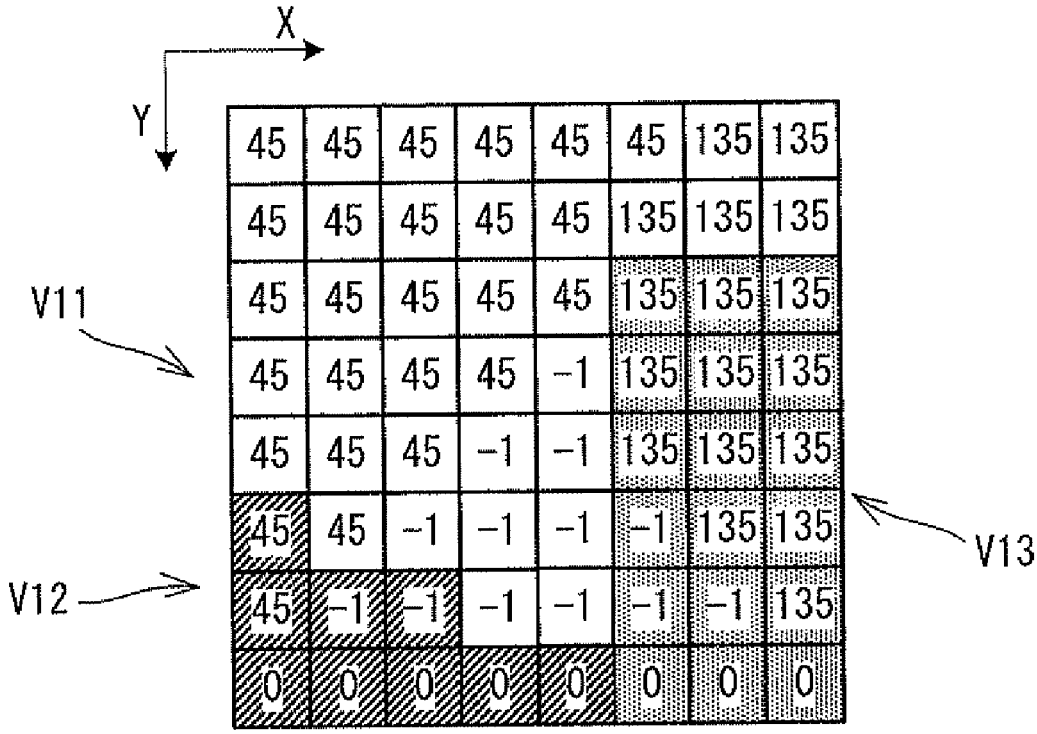
FIG. 17 is an explanatory diagram of first expanded data and second expanded data of the third specific example, at a time point at which processing at Step S80 shown in FIG. 8 is ended.
Figure 18:
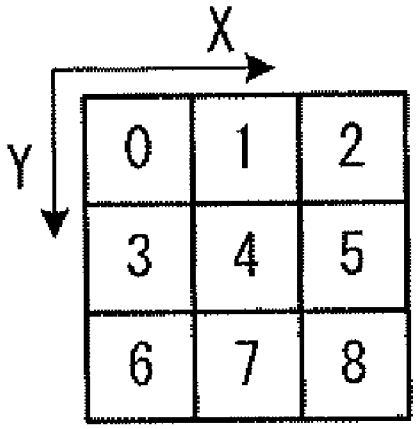
FIG. 18 is an explanatory diagram of processing to read surrounding pixels.

In the unset pixel processing shown in FIG. 16, angle data is set for the unset pixels to which the angle data has not been set in the processing at Step S80. After the processing performed at Step S80, the first expanded data and the second expanded data of the third specific example are as shown in FIG. 17. It is not necessary for data representing the divided area to be attributed to the second expanded data. In the unset pixel processing, first, dx (W), dy (W) are set, and the set dx (W), dy (W) are stored in the RAM 12 (Step S402). In processing to acquire, in order, a surrounding pixel p4 that is a pixel within $\sqrt{2}$ units from the second target pixel p1, a 3×3 pixel group as shown in FIG. 18 is posited. An ID from 0 to 8 is allocated to each of the pixels included in the pixel group shown in FIG. 18, in order from the left to the right and from the top to the bottom. In a case in which the pixel with the ID 4 is the second target pixel p1, the dx (W), dy (W) set at Step S402 are used in processing to identify a position of an nth pixel with respect to the second target pixel p1. At Step S402, dx (W)=(−1, 0, 1, −1, 0, 1, −1, 0, 1), dy (W)=(−1, −1, −1, 0, 0, 0, 1, 1, 1) are set.

Next, similarly to Step S206 shown in FIG. 8, the second target pixel p1 that is the first pixel in order is set, and the set second target pixel p1 is stored in the RAM 12 (Step S404). Following that, the second expanded data is referred to, and it is determined whether the target angle data is set in the second expanded data (Step S406). The second expanded data referred to at Step S406 is the data that is generated and updated at Step S80. At Step S406, the determination is made in a similar manner to the processing at Step S210 shown in FIG. 8. Step S406 is processing to detect, as the detected pixel, the unset pixel after the processing is performed at Step S80. When the target angle data is set in the second expanded data (no at Step S406), processing at Step S440 is performed that will be explained later. When the second target pixel p1 is a pixel (X, Y)=(5, 4) shown in FIG. 17, the angle data corresponding to the second target pixel p1 is not set in the second expanded data (yes at Step S406) and parameters are set and the set parameters are stored in the RAM 12 (Step S408). At Step S408, zero is set as W, and zero is set as Lmax. W is a variable to read the surrounding pixel p4 of the second target pixel p1 in order. Lmax is a variable that is used to acquire a maximum value of a length of the second line segment when the angle data associated with the surrounding pixel p4 is set as the target angle data.

Next, the n-th surrounding pixel p4 is set and the set surrounding pixel p4 is stored in the RAM 12 (Step S412). When the pixel (X, Y)=(5, 4) of the third specific example is the second target pixel p1, when W=0, a pixel (X, Y)=(4, 3) is set as the surrounding pixel p4. Then, it is determined whether the surrounding pixel p4 is extending outside the image (Step S414). Since the pixel (X, Y)=(4, 3) is not extending outside the image (yes at Step S414), the second expanded data is referred to and it is determined whether the angle data corresponding to the surrounding pixel p4 (surrounding angle data) is set in the second expanded data (Step S416). Since the angle data corresponding to the pixel (X, Y)=(4, 3) is set in the second expanded data (yes at Step S416), the second expanded data is referred to, 45 degrees is acquired as the angle θ indicated by the surrounding angle data and the acquired angle θ is stored in the RAM 12 (Step S418).

End point processing is then performed (Step S422). The end point processing performed at Step S422 is similar processing to that performed at Step S216 and Step S218 shown in FIG. 8. However, the processing to update the second expanded data performed at Step 318 and Step S322 shown in FIG. 12 is not performed at Step S422. The two end points Pt-1 and Pt-2 are acquired by the processing at Step S422. In the third specific example, where the current pixel p2 is a pixel (X, Y)=(5, 4) and 45 degrees has been acquired as the angle θ at Step S418, the end point Pt-1 (X, Y)=(5, 4) and the end point Pt-2 (X, Y)=(3, 6) are acquired. Next, a length Lt is calculated of a line segment joining the end point Pt-1 and the end point Pt-2 acquired at Step S422, and the calculated Lt is stored in the RAM 12 (Step S424). A method to calculate the length Lt can be set as appropriate. In the present embodiment, it is assumed that each of the pixels is a 1 unit×1 unit square, and Lt is a length joining a center point of the pixel of the end point Pt-1 and a center point of the pixel of the end point Pt-2. In the third specific example, $2\sqrt{2}$ units is calculated as Lt.

It is then determined whether Lt calculated at Step S424 is larger than Lmax (Step S426). When Lt is larger than Lmax (yes at Step S426), the parameters are updated and the updated parameters are stored in the RAM 12 (Step S428). At Step S428, the end point Pt-1 is set as an end point Pt-11 and the end point Pt-2 is set as an end point Pt-12. The end point Pt-11 and the end point Pt-12 represent candidates of both ends of the second line segment data overlapping with the second target pixel p1. The angle θ acquired at Step S418 is set as θm. θm represents a candidate for an angle represented by the angle data corresponding to the second target pixel p1 (specific surrounding angle data). The Lt calculated at Step S424 is set as Lmax.

Processing at Step S430 is performed in any of the following cases: when, at Step S414, the surrounding pixel p4 is extending outside the image (no at Step S414); when, at Step S416, the angle data is not set in the second expanded data (no at Step S416); when the Lt is equal to or smaller than Lmax (no at Step S426); and after Step S428. At Step S430, it is determined whether W is smaller than 8 (Step S430). When W is smaller than 8 (yes at Step S430), W is incremented, and the incremented W is stored in the RAM 12 (Step S436). Next, when W is 4 (yes at Step S438), the processing returns to Step S436. The pixel when W is 4 corresponds to the second target pixel p1. By the processing at Step S438, the pixel W=4 is not set as the surrounding pixel p4. When W is not 4 (no at Step S438), the processing returns to Step S412.

When, at Step S430, W is 8 (no at Step S430), the second expanded data is updated based on the parameters set at Step S428, and the updated second expanded data is stored in the expanded data storage area 156 (Step S432). At Step S432, the specific surrounding angle data representing the angle θm is set for the pixels overlapping with the line segment that has as its end points the two end points Pt-11 and Pt-12 set at Step S428. Then, the second expanded data is updated. Next, the second line segment data is generated and the generated second line segment data is stored in the line segment data storage area 153 (Step S434). Processing at Step S434 is processing that is similar to that at Step S220 shown in FIG. 8, and the second line segment data is generated that represents the second line segment that has as its ends the two end points Pt-11 and Pt-12 set at Step S428.

Figure 19:
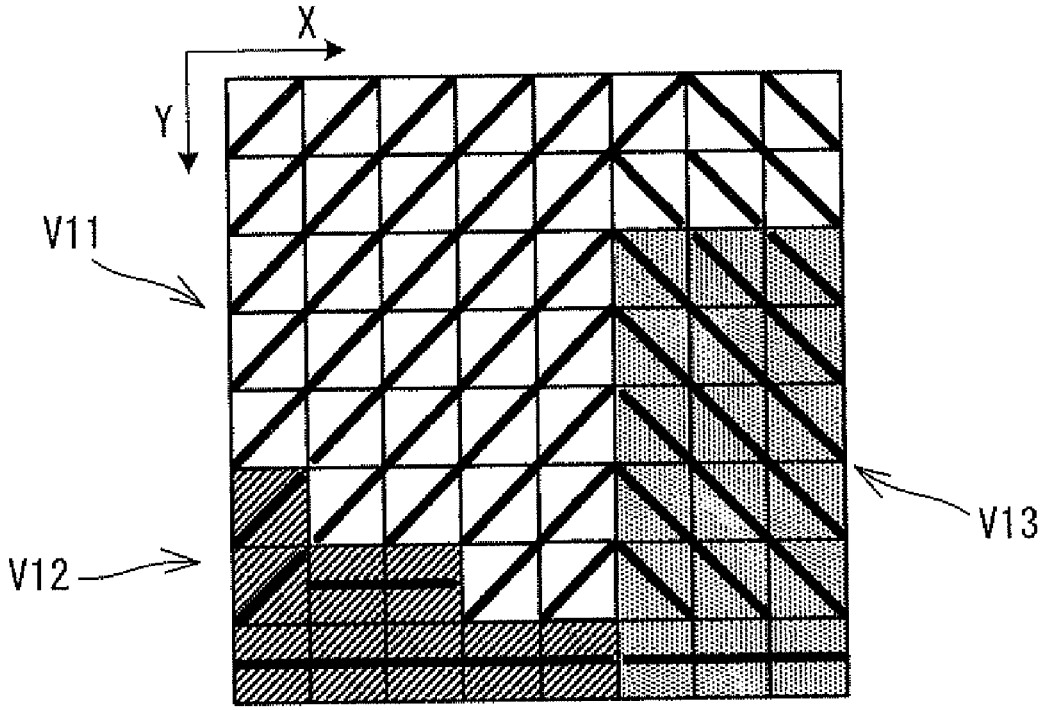
FIG. 19 is an explanatory diagram that shows, of the third specific example, associations between pixels forming an image, divided areas in which each of the pixels is included, and positions on the image of second line segments represented by the second line segment data generated in the main processing.

Following this, it is determined whether all of the pixels have been set as the second target pixel p1 (Step S440). When at least one pixel has not been set as the second target pixel p1 (no at Step S440), the next pixel in order is set as the second target pixel p1 and the newly set second target pixel p1 is stored in the RAM 12 (Step S442). The processing then returns to Step S406. When, at Step S440, all the pixels have been set as the second target pixel p1 (yes at Step S440), the unset pixel processing ends. In the third specific example, when the main processing of the second embodiment is performed, the second line segment data representing the second line segments shown in FIG. 19 is generated by the second line segment data generation processing at Step S80 and the unset pixel processing. In FIG. 19, all of the pixels overlap with one of the second line segments. The processing at Step S90, Step S100 and Step S110 in the main processing shown in FIG. 4 is performed on the second line segment data that is generated at Step S80 and on the second line segment data that is generated by the above-described unset pixel processing.

When the embroidery data generating apparatus 1 according to the second embodiment cannot generate the second line segment data representing the second line segment overlapping with the unset pixels by extending the first line segment in the extension direction of the first line segment, the following processing is performed. Specifically, the embroidery data generating apparatus 1 sets the specific surrounding angle data as the angle data corresponding to the unset pixel. By this, the embroidery data generating apparatus 1 can generate the embroidery data to form the embroidery pattern with an increased ratio of stitches that are aligned in the same direction. As a result, compared with a case in which a low ratio of stitches are aligned in the same direction, the embroidery data generating apparatus 1 can generate the embroidery data that forms the embroidery pattern with a natural finish.

In the third specific example, with respect to the unset pixels within the area V11, the second line segment data pieces representing the second line segments with an angle of 45 degrees is generated based on the angle data corresponding to the surrounding pixel p4 within the area V11, as shown in FIG. 19. With respect to the unset pixels within the area V12, the second line segment data piece representing the second line segment with an angle of zero degrees is generated based on the angle data corresponding to the surrounding pixel p4 within the area V12, as shown in FIG. 19. With respect to the unset pixels within the area V13, the second line segment data pieces representing the second line segments with an angle of 135 degrees is generated based on the angle data corresponding to the surrounding pixel p4 within the area V13, as shown in FIG. 19. When considering the pixels that overlap with one of the second line segments generated by the embroidery data generating apparatus 1, each of the pixels is the pixel of the same divided area. Thus, the embroidery data generating apparatus 1 can generate the embroidery data to form the embroidery pattern that appropriately expresses changes in color of the whole image by the stitches.

Hereinafter, main processing according to a third embodiment will be explained. The main processing according to the third embodiment is executed by the CPU 11 in accordance with the embroidery data generating program stored in the program storage area 161 of the HDD 15.

Figure 20:
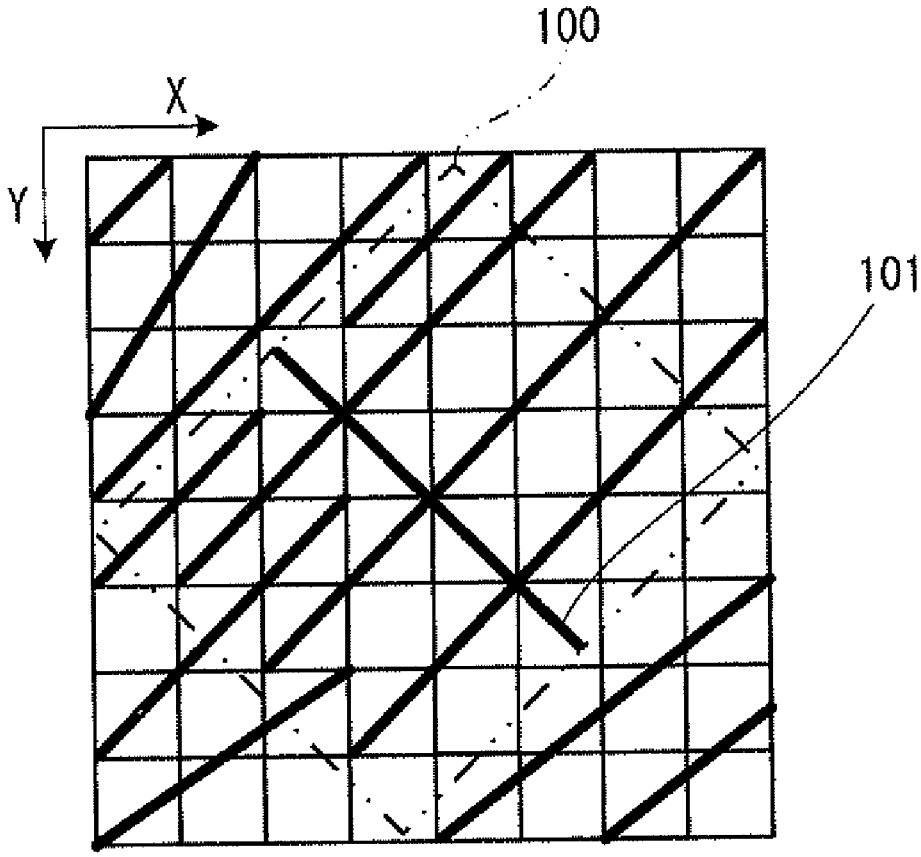
FIG. 20 is an explanatory diagram that schematically shows, of a fourth specific example, pixels that form an image and positions on the image of first line segments represented by the first line segment data generated in the main processing.
Figure 21:
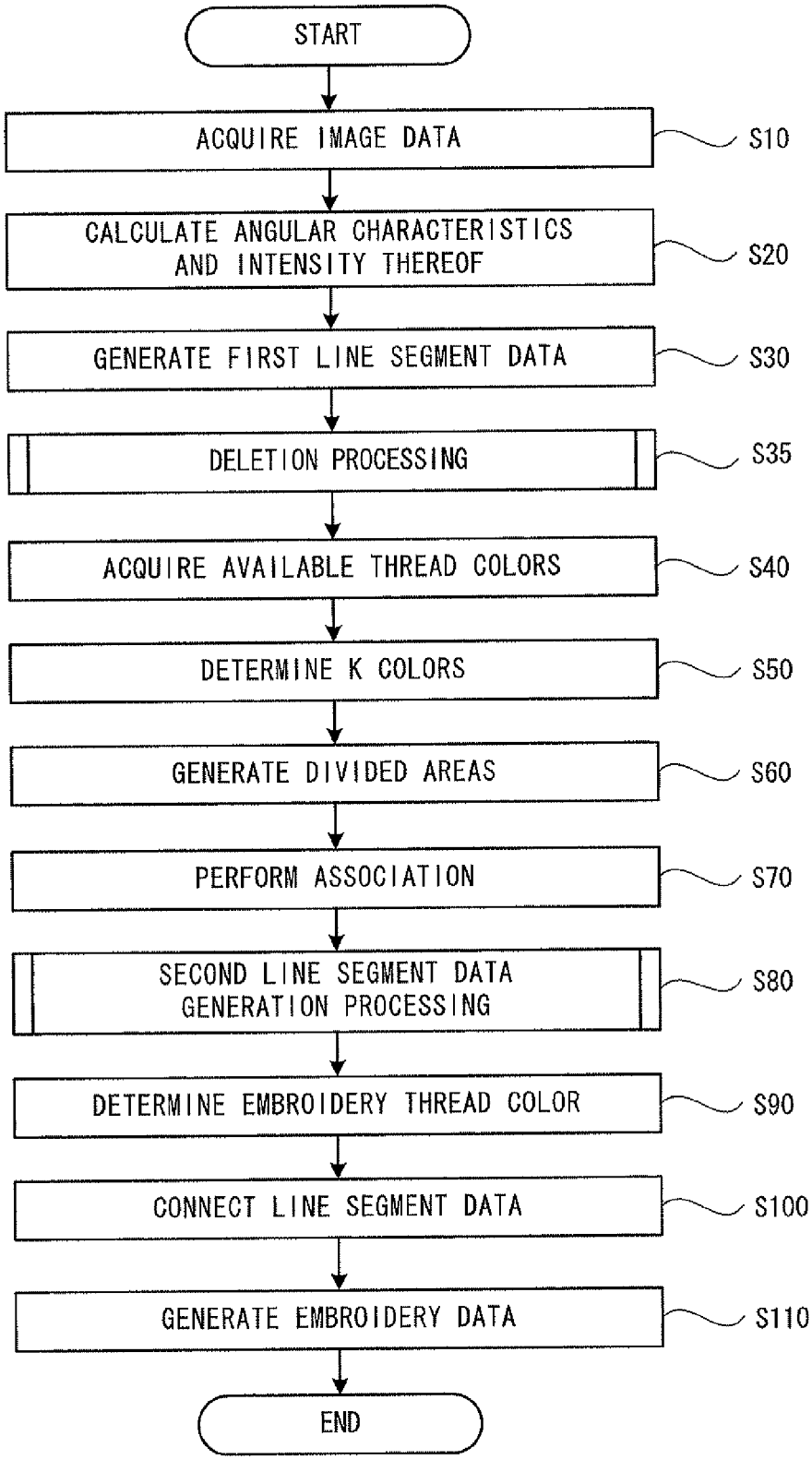
FIG. 21 is a flowchart of main processing.

In FIG. 21, the same reference numerals are attributed to processing that is similar to that of the main processing of the first embodiment shown in FIG. 4. As shown in FIG. 21, the main processing of the third embodiment is different to the main processing of the first embodiment in that deletion processing is performed at Step S35, between Step S30 and Step S40. An explanation is omitted of processing that is the same as that of the first embodiment, and hereinafter, processing at Step S35, which is different to the processing of the first embodiment, will be explained. As a fourth specific example, a case is assumed in which the first line segment data representing the line segments shown in FIG. 20 is generated at Step S30.

At Step S35, processing is performed to delete, of the first line segment data pieces generated at Step S30, the first line segment data piece that fulfils predetermined condition. As the predetermined condition, both the following two conditions are to be met. The first condition is that the first line segment data piece be data representing the first line segment that overlaps with the pixel of an area outside a high frequency area. The high frequency area is an area in which a spatial frequency component is larger than a predetermined value. The second condition is that the first line segment data piece is data piece in which a total sum of differences between the angle (tilt) of the first line segment represented by the first line segment data piece and the angle (tilt) of another of the first line segments that is positioned within a predetermined distance Dn (the distance Dn being in a direction orthogonal to the first line segment) is equal to or larger than a predetermined value. The deletion processing will be explained in more detail with reference to FIG. 22.

Figure 22:
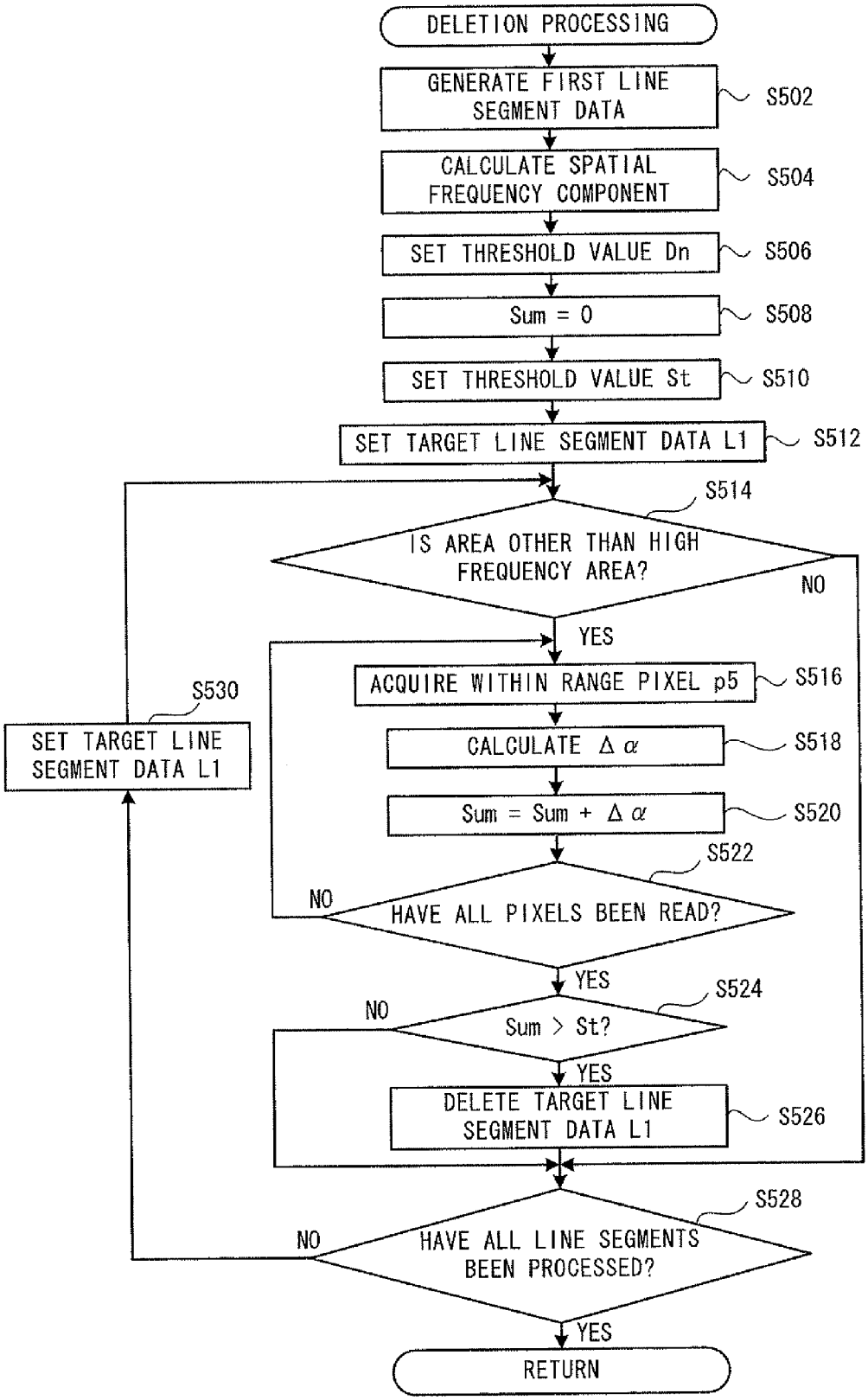
FIG. 22 is a flowchart of deletion processing performed in the main processing shown in FIG. 21.
Figure 23:
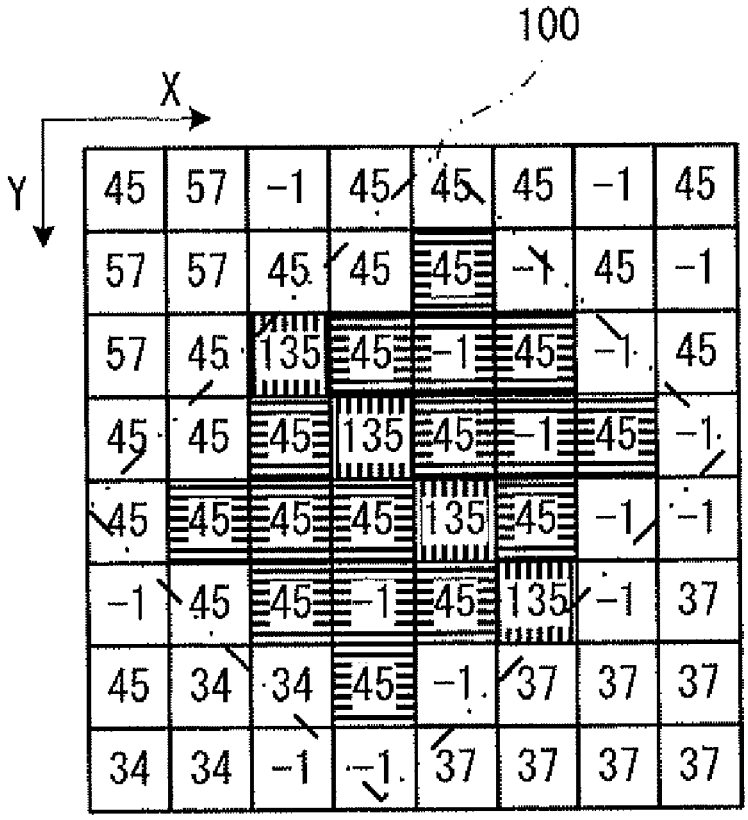
FIG. 23 is an explanatory diagram of first expanded data of the fourth specific example that is generated in the deletion processing shown in FIG. 22.

As shown in FIG. 22, in the deletion processing, first, the first expanded data is generated based on the first line segment data generated at Step S30, and the generated first expanded data is stored in the RAM 12 (Step S502). In the fourth specific example, the first expanded data is generated as shown in FIG. 23. Next, based on the image data acquired at Step S10 shown in FIG. 21, the spatial frequency component of each of the pixels is calculated, and relationships between the pixels and the calculated spatial frequency components are stored in the RAM 12 (Step S504). The spatial frequency component indicates differences of attribute values related to color. Compared to when the difference in the attribute value between one of the pixels and the adjacent pixel is small, the larger the difference in the attribute value between the pixel and the adjacent pixel, the larger the spatial frequency component. A known method can be adopted to calculate the spatial frequency component. For example, Japanese Laid-Open Patent Publication No. 2002-263386 discloses a method to calculate the spatial frequency component, the relevant portions of which are herein incorporated by reference.

Next, a threshold value Dn is set and the set threshold value Dn is stored in the RAM 12 (Step S506). The threshold value Dn establishes a positional range of a line segment whose angle is compared with an angle of a target line segment. The threshold value Dn is appropriately established while taking into account a minimum unit of the stitch, and in the present embodiment, 1 mm is set as the threshold value Dn. In the present embodiment, the threshold value Dn is shorter than the minimum unit of the stitch, which is 3 mm. Next, zero is set as Sum and the set Sum is stored in the RAM 12 (Step S508). Sum is a parameter to calculate a total sum of $\Delta\alpha$. $\Delta\alpha$ is an absolute value of a difference between an angle $\alpha$1 and an angle $\alpha$2. The angle $\alpha$1 is an angle of a target line segment L2 that is represented by target line segment data L1 acquired at Step S512, which will be explained later. The angle $\alpha$2 is an angle indicated by the angle data associated with the pixel (hereinafter referred to as a "within range pixel p5") which is positioned at a distance within a range of Dn in an orthogonal direction to the target line segment L2. Then, a threshold value St is set and the set threshold value St is stored in the RAM 12 (Step S510). The threshold value St is compared with Sum and is used as a reference to determine whether to delete the target line segment data L1 representing the target line segment L2. The threshold value St is determined while taking into account conditions, which include the threshold value Dn set at Step S506 and the density of the first line segments represented by the first line segment data. In the present embodiment, 540 degrees is set in advance as the threshold value St. Next, the first line segment data piece which is acquired first in order is set as the target line segment data L1, and the acquired target line segment data L1 is stored in the RAM 12 (Step S512). The target line segment data L1 is the data when the first line segment data piece generated at Step S30 is read in order. The order of acquisition of the target line segment data L1 is, for example, the same as the order of acquisition of the first target pixel corresponding to the target line segment data L1. At Step S512, the first line segment data piece corresponding to (X, Y)=(1, 1) is set as the target line segment data L1.

Figure 24:
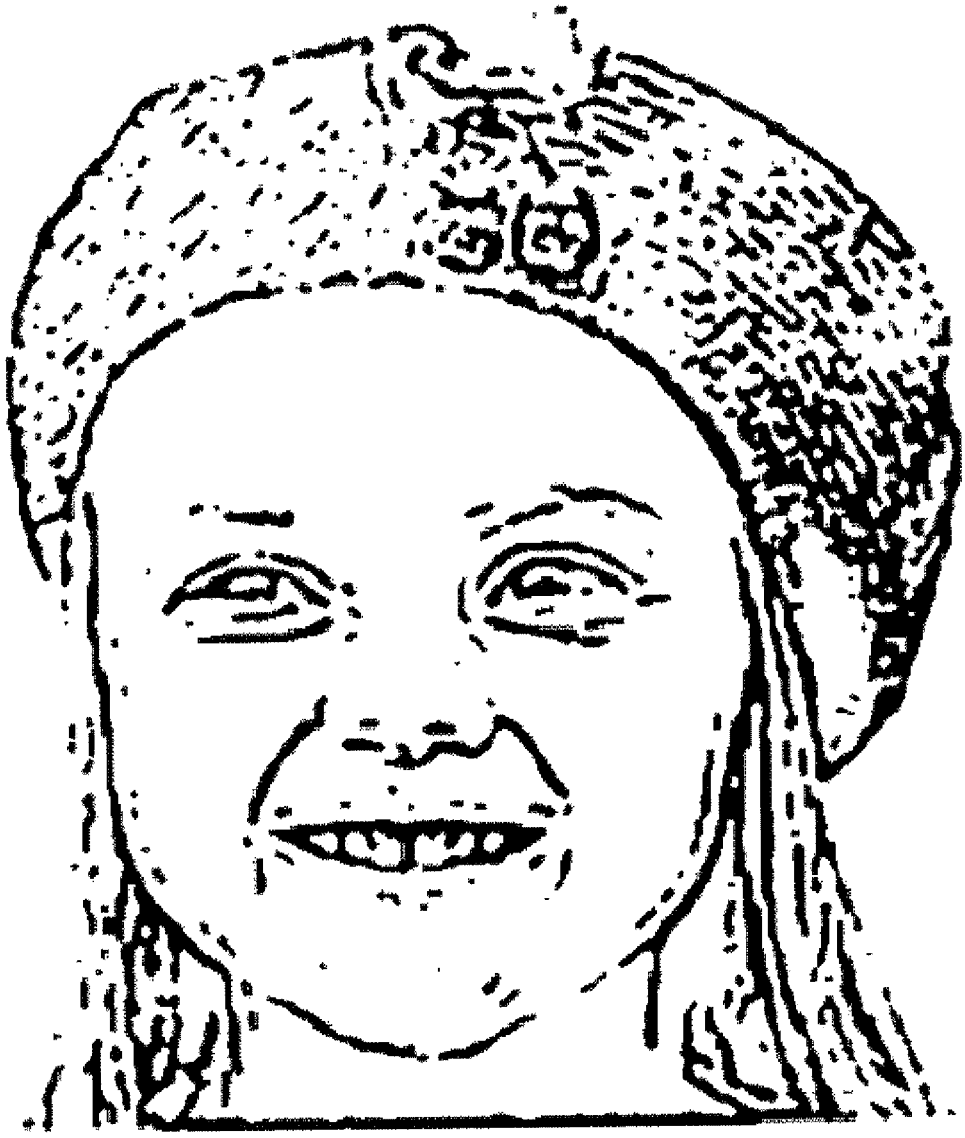
FIG. 24 is an explanatory diagram in which, from the image of the first specific example, high frequency areas have been extracted which have a spatial frequency component that is greater than a predetermined value.

It is then determined whether the pixels that overlap with the target line segment L2 represented by the target line segment data L1 acquired at Step S512 (the pixels shaded with vertical lines shown in FIG. 23) are the pixels of an area other than the high frequency area (namely, low frequency pixels) (Step S514). A threshold of the spatial frequency component that determines whether the area is the high frequency area is set in advance while taking into account changes in color of the image. In the present embodiment, the spatial frequency component is normalized with a maximum value of the spatial frequency component being set as 100 and a minimum value thereof being set as 0, and 50 is set as the threshold of the normalized spatial frequency component. The threshold of the spatial frequency component may be set by the user each time the main processing is performed. In the present embodiment, the high frequency area is the area in which the normalized spatial frequency component is larger than the threshold. The area in which the normalized spatial frequency component is equal to or lower than the threshold is the area other than the high frequency area. In the first specific example shown in FIG. 5, black areas shown in FIG. 24 are the high frequency areas and white areas shown in FIG. 24 are the areas other than the high frequency areas. As shown in FIG. 24, the high frequency areas are areas in which there are significant changes in color, such as contours of the face. When the pixels that overlap with the target line segment L2 are the pixels of the area other than the high frequency area (yes at Step S514), the within range pixels p5 are read in order (Step S516). In the fourth specific example, the pixels within a range of 100 shown in FIG. 23 (the pixels that are shaded with horizontal lines shown in FIG. 23) are read as the within range pixel p5, in order from left to right and top to bottom. Next, $\Delta\alpha$ is calculated, and the calculated $\Delta\alpha$ is stored in the RAM 12 (Step S518). When the target line segment L2 represented by the target line segment data L1 acquired at Step S512 is a line segment 101 shown in FIG. 20, the angle α1 is 135 degrees. When the within range pixel p5 read at Step S516 is the pixel (X, Y)=(5, 2) shown in FIG. 21, the angle α2 is 45 degrees. In this case, Δα is 90 degrees. At Step S518, Δα is not calculated when the angle data corresponding to the within range pixel p5 is −1.

Following the above, a sum of Sum and Δα calculated at Step S518 is calculated, and the calculation result is stored in the RAM 12 as Sum (Step S520). It is then determined whether all of the within range pixels p5 have been read at Step S516 (Step S522). If the within range pixel p5 that has not been read remains (no at Step S522), the processing returns to Step S516 and the next within range pixel p5 in order is read (Step S516). When all of the within range pixels p5 have been read (yes at Step S522), it is determined whether Sum is larger than St (Step S524). In the fourth specific example, Sum is 1170 degrees, which is larger than St, which is 540 degrees (yes at Step S524) and therefore, the first line segment data piece corresponding to the target line segment data L1 acquired at Step S512 is deleted from the line segment data storage area 153 (Step S526). In addition, at Step S526, of the angle data piece associated with the pixels that overlap with the target line segment L2, the angle data piece representing the extension direction of the target line segment L2 is deleted from the first expanded data.

Processing at Step S528 is performed in any of the following cases: when the pixels that overlap with the target line segment L2 at Step S516 are the pixels of the high frequency area (no at Step S514); when, at Step S524, Sum is equal to or lower than St (no at Step S524); and following Step S526. At Step S528, it is determined whether all of the first line segment data pieces have been set at Step S512 or at Step S530 as the target line segment data L1 (Step S528). When the first line segment data piece remains that has not been set as the target line segment data L1 (no at Step S528), the next first line segment data piece in order is set as the target line segment data L1 and the set target line segment data L1 is stored in the RAM 12 (Step S530). The processing then returns to Step S514. When all of the first line segment data pieces have been acquired (yes at Step S528), the deletion processing ends. In the first specific example, when the first line segment data pieces representing the line segments shown in FIG. 6 are generated at Step S30, and the deletion processing is performed at Step S35, line segments shown in FIG. 25 are not deleted and remain. When FIG. 5 and FIG. 25 are compared, for example, some of the line segments expressing the hat in an upper left section of FIG. 5 are deleted in FIG. 25.

In the embroidery data generating apparatus 1 according to the third embodiment, the embroidery data is generated that avoids a case in which the stitches that express the areas which are other than the high frequency areas and which have relatively small changes in color become stitches that extend in an unnatural direction that significantly differs from the extension directions of the surrounding stitches. On the other hand, in the embroidery data generating apparatus 1, in the areas which have relatively large changes in color, even in a case in which the extension directions of the surrounding stitches are significantly different, the embroidery data is generated that allows such stitches to be formed. As a result, the embroidery data generating apparatus 1 can generate the embroidery data that appropriately expresses the high frequency areas which have large changes in color using stitches representing those changes, and that avoids the appearance of noise among stitches in the areas which have small changes in color (the areas other than the high frequency areas). In other words, the embroidery data generating apparatus 1 can generate the embroidery data that forms the embroidery pattern with a more natural finish.

Figure 26:
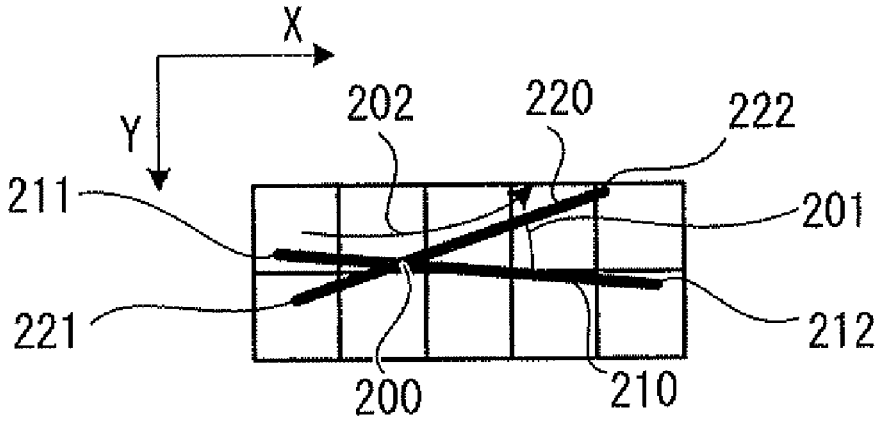
FIG. 26 is an explanatory diagram that shows, of a fifth specific example, associations between pixels forming an image and positions on the image of first line segments represented by the first line segment data generated in the main processing.
Figure 27:
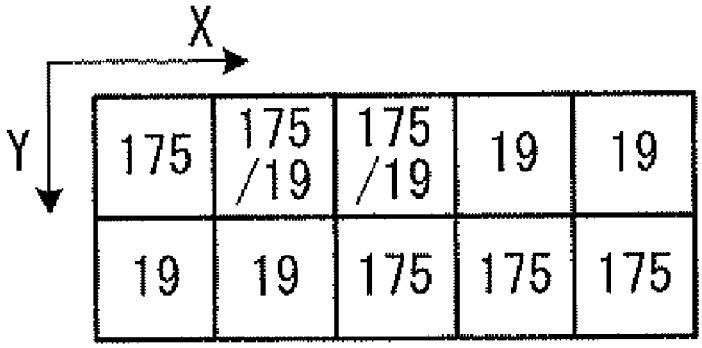
FIG. 27 is an explanatory diagram of first expanded data of the fifth specific example.

Hereinafter, main processing according to a fourth embodiment will be explained, with reference to FIGS. 26 to 28. The main processing according to the fourth embodiment is executed by the CPU 11 in accordance with the embroidery data generating program stored in the program storage area 161 of the HDD 15.

Although not shown in the drawings, the main processing of the fourth embodiment differs from the main processing of the first embodiment in Step S216 to Step S220 of the second line segment data generation processing performed at Step S80 shown in FIG. 4. In other respects, the processing is the same. Hereinafter, an explanation will be omitted of the processing that is the same as the main processing of the first embodiment, and the processing that is different to the main processing of the first embodiment will be described. A fifth specific example is assumed in which, at Step S30 of the main processing that is the same as that of the first embodiment, the first line segment data piece representing a line segment 210 that joins an end point 211 and an end point 212, and the first line segment data piece representing a line segment 220 that joins an end point 221 and an end point 222 are generated, as shown in FIG. 26. In the fifth specific example, at Step S202 of the second line segment data generation processing, the first expanded data is generated as shown in FIG. 27. In the present embodiment, as shown in FIG. 27, a case is assumed in which a plurality of angle data pieces corresponding to a plurality of first line segments are associated with the pixel on which the plurality of first line segments overlap.

Figure 28:
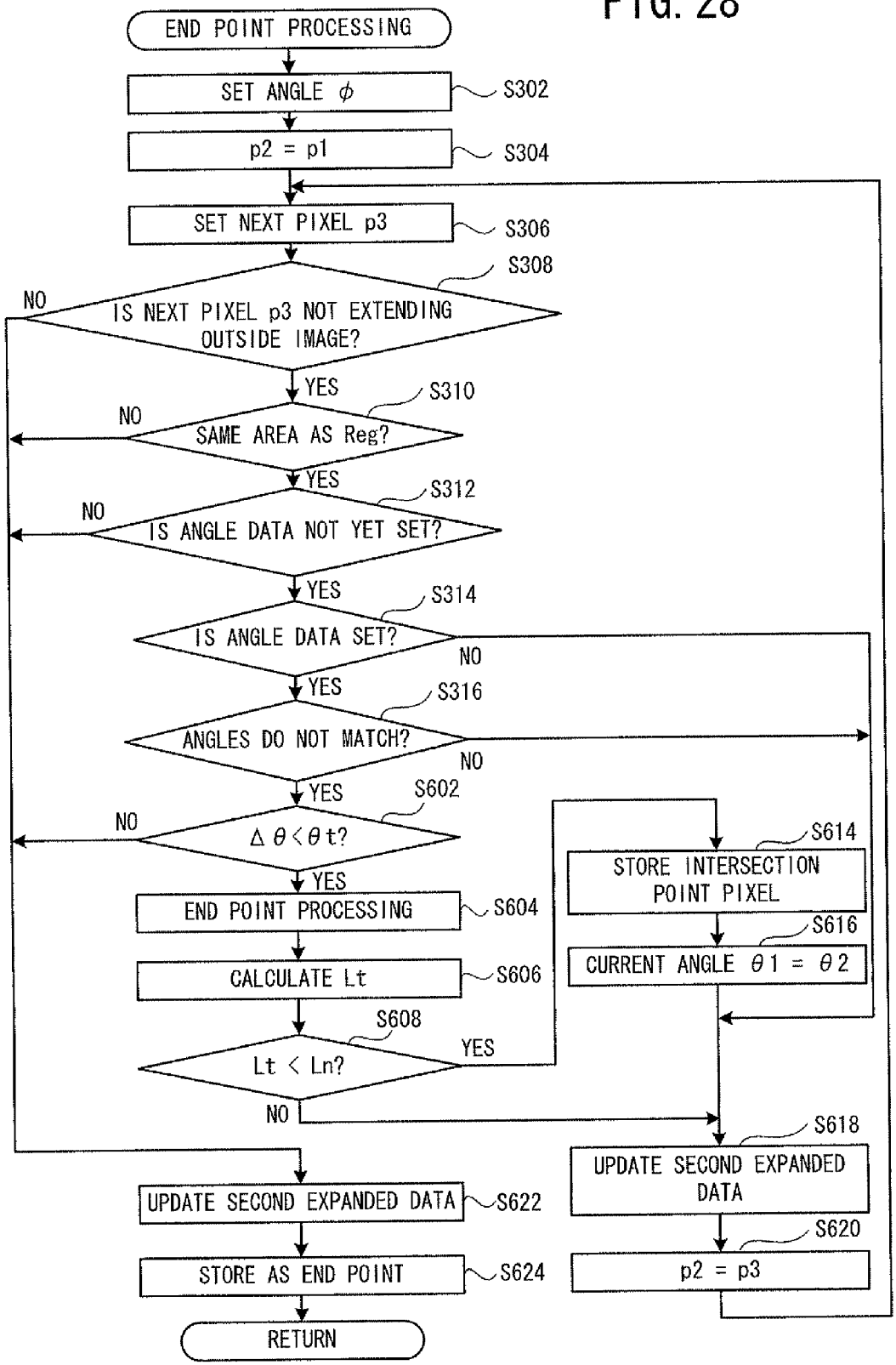
FIG. 28 is a flowchart of end point processing.

The end point processing shown in FIG. 28 is performed at Step S216 and Step S218 of the fourth embodiment, respectively. In FIG. 28, the same step number is allocated to the processing that is the same as that of the end point processing shown in FIG. 12. As shown in FIG. 28, the end point processing of the fourth embodiment differs from the end point processing of the first embodiment shown in FIG. 12 in that processing at Step S604 to Step S624 are performed in place of the processing at Step S318 to Step S324. An explanation is here simplified or omitted of the processing that is the same as that of the end point processing of the first embodiment. The processing at Step S604 to S624, which is different to the end point processing of the first embodiment, and the processing at Step S316 will be described hereinafter.

At Step S316, which is the same as in the first embodiment, when θ1 is the angle θ set at Step S214 shown in FIG. 8, and an angle indicated by the angle data corresponding to the next pixel p3 (reference angle data) is θ2, it is determined whether the angle θ1 and the angle θ2 do not match (Step S316). When the pixel of the fifth specific example is (X, Y)=(1, 1) and the next pixel p3 is (X, Y)=(1, 2), θ1 is 175 degrees and θ2 is 19 degrees and 175 degrees. When a plurality of angles are set for the next pixel p3, of the plurality of angles, the angles different to θ1 are compared to θ1, respectively. When θ1 is 175 degrees and θ2 is 19 degrees (yes at Step S316), it is determined whether Δθ is smaller than θt (Step S602). Δθ indicates an angle that is equal to or less than 90 degrees, among the angles formed by the intersecting first line segments. When an absolute value of the difference between θ2 and θ1 is equal to or less than 90 degrees, the absolute value of the difference between θ2 and θ1 is set as Δθ. When an absolute value of the difference between θ2 and θ1 is greater than 90 degrees, an absolute value that is obtained by subtracting 180 degrees from the absolute value of the difference between θ2 and θ1 is set as Δθ. θt is a threshold value that is appropriately set while taking into account a tolerance of difference in the angles of the stitches, in a case in which it can be assumed that the embroidery pattern will have an unnatural finish, due to the stitch that has a significantly different angle to the other stitches positioned surrounding the stitch. In the present embodiment, θt is set as 25 degrees. In the above-described fifth specific example, Δθ is 24 degrees (as indicated in FIG. 26 by the angle 201). When the plurality of Δθ are obtained, a smaller value of Δθ is referred to, for example.

When Δθ is equal to or greater than θt (no at Step S602), processing at Step S622, which will be explained later, is performed. In the fifth specific example, Δθ is 24 degrees, which is smaller than 25 degrees set as θt (yes at Step S602), and thus the first expanded data is referred to and the end point processing with respect to θ2+180 degrees is performed (Step S604). θ2 and θ2+180 degrees represent the extension directions represented by the reference angle data (intersection angle data) that satisfies Δθ<θt. In the end point processing relating to θ2+180 degrees, by the similar processing as the end point processing shown in FIG. 12, of the end points of the line segment 220 that intersects with the line segment 210 as shown in FIG. 26, processing is performed to identify the end point in the direction θ2+180 degrees as seen from the point of intersection. It should be noted that, at Step S604, the processing at Step S318 and at Step S322 to update the second expanded data shown in FIG. 12 is not performed. At Step S604, with respect to Step S316 shown in FIG. 12, when the plurality of angle data pieces are associated with a single one of the pixels, values in which the difference with θ1 is not zero are referred to, for example. By the end point processing at Step S604, the pixel (X, Y)=(2, 1) that includes an intersection point 200 (hereinafter referred to as an "intersection point pixel") and the pixel (X, Y)=(1, 2) that includes the end point 221 (hereinafter referred to as an "end point pixel") are identified.

Next, the distance Lt is calculated from the intersection point pixel to the end point pixel identified at Step S604, and the calculated distance Lt is stored in the RAM. 12 (Step S606). The distance Lt is used as an index of a number of pixels that are in the extension directions represented by the intersection angle data as seen from the intersection point pixel and that are associated with the angle data representing the same angle as the angle indicated by the intersection angle data. A method for calculating a length of the distance Lt may be adopted as appropriate. For example, the distance Lt may be a length of a line segment that joins a center point of the intersection point pixel and a center point of the end point pixel. Alternatively, when the length of the first line segment is shorter than the size of one pixel and the pixel, the distance Lt may be, for example, ΔX/cos θ2 calculated based on the angle θ2 and ΔX, where ΔX is a difference between the X coordinate of the intersection point pixel and the X coordinate of the end point pixel. Next, it is determined whether the distance Lt calculated at Step S606 is smaller than a threshold value Ln (Step S608). The threshold value Ln is set as appropriate, taking into account the length of the first line segment and a length of the sewable stitch. For example, a value from ¼ to ⅓ of the length of the first line segment is set as the threshold value Ln. When the distance Lt is smaller than the threshold value Ln (yes at Step S608), the next pixel p3 is stored in the RAM 12 as the intersection point pixel (Step S614). Then, the angle θ2 is set as the current angle θ1, and the newly set current angle θ1 is stored in the RAM 12 (Step S616). In the fifth specific example, 19 degrees is set as the current angle θ1. Processing at Step S618 is performed in any of the following cases: when, at Step S314, the next pixel p3 is not set in the first expanded data (no at Step S314); when, at Step S316, the angle indicated by the angle data associated with the next pixel p3 matches the angle θ acquired at Step S214 shown in FIG. 8 (no at Step S316); when, at Step S608, the distance Lt is equal to or greater than the threshold value Ln (no at Step S608); and after Step S616. At Step S618, the second expanded data is updated in a similar manner to the processing at Step S318 shown in FIG. 12. Next, the next pixel p3 is set as the current pixel p2 and the newly set current pixel p2 is stored in the RAM 12 (Step S620). Following this, the processing returns to Step S306. In the fifth specific example, by repeatedly performing the processing, the pixels in a direction represented by an arrow 202 are set in order as the next pixel p3.

Processing at Step S622 is performed in any of the following cases: when, at Step S308, the next pixel p3 is extending outside the image (no at Step S308); when, at Step S310, the next pixel p3 is not of the same area as Reg (no at Step S310); when, at Step S312, the next pixel p3 is not set in the second expanded data (no at Step S312); and when, at Step S602, Δθ is equal to or greater than θt (no at Step S602). When a pixel (X, Y)=(5, 1) of the fifth specific example is set as the current pixel p2, the next pixel p3 is extending outside the image (no at Step S308) and thus, after the second expanded data is updated, the current pixel p2 is stored as the end point (Step S622 and Step S624). The end point processing is then ended, and the processing returns to the second line segment data generation processing shown in FIG. 8. When the intersection point has been stored at Step S614, at Step S220 of the second line segment data generation processing shown in FIG. 8, the second line segment data is generated that represents a group of line segments formed of the line segment that joins the one end point pixel stored at Step S624 and the intersection point pixel of Step S614, and of the line segment that joins the intersection point pixel to the other end point pixel. In the fifth specific example, the second line segment data is generated that represents a group of line segments formed of the line segment that joins the pixel including the end point 211 with the pixel including the intersection point 200, and of the line segment that joins the pixel including the intersection point 200 with the pixel including the end point 222. When the second line segment data is generated that represents the group of line segments at Step S220, it is considered that the group of line segments represented by the second line segment data are continuous.

The embroidery data generating apparatus 1 of the fourth embodiment generates the second line segment data representing the line segments that are connected at the intersection point of two of the first line segments having a similar angle (tilt). In this way, the embroidery data can be generated with a high ratio of continuous (long) stitches, thus forming more natural stitches as the embroidery pattern.

The embroidery data generating apparatus according to the present disclosure is not limited to the above-described embodiments, and various modifications may be employed insofar as they are within the scope of the present disclosure. For example, the following modified examples (A) to (H) may be employed as appropriate.

(A) In the above-described exemplary embodiments, the embroidery data generating apparatus 1 is a personal computer, but a sewing machine (for example, the embroidery sewing machine 3) on which the embroidery data generating program is stored may generate the embroidery data.

(B) The first line segment data generation method at Step S30 shown in FIG. 4 can be modified as appropriate. In the above-described exemplary embodiments, in the main processing shown in FIG. 4, the first line segment data is generated based on the angular characteristic data calculated from the pixel data, but the first segment data may be generated in accordance with another known line segment data generating method. For example, Japanese Laid-Open Patent Publication No. 2000-288275 discloses the generating method of the first line segment data, the relevant portions of which are herein incorporated by reference.

(C) The divided area generation method at Step S60 shown in FIG. 4 can be modified as appropriate. With the embroidery data generating apparatus of the above-described exemplary embodiments, the divided area is determined by performing the color reduction processing on the original image. The median cut algorithm is given as an example of the color reduction method, but other methods may be adopted, such as a uniform quantization method, a tapered quantization method and so on. Similarly, in the above-described exemplary embodiments, for ease of explanation, it is assumed that pixels having the same color as a result of color reduction are included in the same divided area. Alternatively the embroidery data generating apparatus may, for example, set, as the same divided area, area in which pixels have the same color and are contiguous as a result of color reduction.

(D) The expanded data generation method and its content can be modified as appropriate. The expanded data may be data in which the pixels that overlap with the first line segment represented by the first line segment data are associated with the angle data representing the extension direction of the first line segment. For example, data that indicates whether the second line segment data has been generated may be attached to the same first expanded data as the above-described embodiments, and generated as the expanded data.

(E) The method for detecting the unset pixel as the detected pixel can be modified as appropriate. For example, at Step S306 shown in FIG. 12, the next pixels p3 are read in ascending order of distance from the second target pixel p1, the next pixels p3 being the pixels that are in the extension direction indicated by the angle $\phi$ as seen from the second target pixel p1. However, a order of reading the next pixels p3 is not limited to this example. For example, the pixels in the extension direction indicated by the angle $\phi$ as seen from the second target pixel p1 may be read from the closest distance to the second target pixel p1 every predetermined number of pixels (every other pixel, for example). Alternatively, in a case in which the embroidery data is generated based on the image data representing the image that has a small number of unset pixels, the processing to detect the unset pixel as the detected pixel may be omitted as appropriate.

(F) The method to update the second expanded data as the expanded data can be modified as appropriate. For example, processing to set the angle data corresponding to the detected pixel may be performed only for the detected pixel that fulfils predetermined conditions. For example, when the density of the second line segments is within a predetermined range, the processing to set the angle data corresponding to the detected pixel need not be performed, even when the detected pixel is detected. Namely, there may be pixels that do not overlap with the second line segments. When the embroidery data is generated based on the image data representing the image with a small number of unset pixels and so on, the processing to update expanded data may be omitted as appropriate.

(G) The second line segment data generation method can be modified as appropriate. For example, the following modifications (G-1) to (G-6) may be added.

(G-1) In the above-described embodiments, all of the pixels overlapping with the second line segment represented by the second line segment data piece are pixels of the same divided area. However, for example, a predetermined ratio of pixels that overlap with the second line segment or a predetermined number of pixels that overlap with the second line segment may be pixels of a different divided area to that of the other pixels.

(G-2) In a case in which the second line segment is too short, the second line segment cannot be expressed using the stitches. As the stitches corresponding to the second line segment are stitches of the same color, when the length of the second line segment is excessively long in comparison to the line segments arranged surrounding the second line segment, the embroidery pattern may have an unnatural finish. In this type of case, for example, the second line segment data piece may be generated such that the second line segment is a line segment whose length is within a predetermined range.

(G-3) For example, in the embroidery data generating apparatus 1, at Step S310 of the end point processing shown in FIG. 12, it is determined whether the next pixel p3 is in the same area as the second target pixel p1, but the present invention is not limited to this example. For example, when generating the embroidery data based on the image data representing the image with small changes in color, the embroidery data generating apparatus 1 may omit the processing at Step S310.

(G-4) In the first embodiment, the first line segments that overlap with pixels in different divided areas are not connected even if they are the first line segments indicating the same angle data. However, the present invention is not limited to this example. For example, the second line segment data may be generated as described hereinafter. The embroidery data generating apparatus 1 first generates line segment data representing a line segment that connects the first line segments which have a similar angle, and then, in accordance with the divided area to which each of the pixels belongs, cuts the first line segment represented by the first line segment data. The embroidery data generating apparatus 1 generates the second line segment data representing the second line segment generated as a result of cutting the line segment. In this case, it may be determined whether to cut the line segment connecting the first line segments based on a length of the second line segment generated as a result of cutting the line segment.

(G-5) In the above-described embodiments, the pixel area formed by the extension direction pixels and the second target pixel p1 is a single continuous area, but the pixel area may be a plurality of separate areas. When the pixel area that is formed by the extension direction pixels that overlap with the second line segment and by the second target pixel p1 is the plurality of separate areas, it is preferable for distances between each of the areas to be short. In the above-described embodiments, the angle indicated by the angle data of the extension direction pixels is the same as the angle indicated by the second target pixel p1, but the angle indicated by the angle data of the extension direction pixels may be similar to the angle indicated by the second target pixel p1. A range of similar angles may be established as appropriate while taking into account a tolerance value in which the extension directions of the line segments can be determined to be the same.

(G-6) When the line segment that has the same angle as the first line segment that overlaps with the surrounding pixels is generated as the second line segment that overlaps with the unset pixels, the angle data of the pixels included in the divided area that is different to that of the unset pixels is sometimes identified as specific surrounding pixel data. In this case, when there is a significant difference in color between the different divided areas, it is possible that the stitches corresponding to the second line segment data cannot appropriately represent a direction in changes in color within the divided area. In this type of case, processing may be performed between Step S414 and Step S416 shown in FIG. 16, to determine whether the surrounding pixel p4 is a pixel in the same divided area as the second target pixel p1 set at Step S404. In this case, when the surrounding pixel p4 is the pixel in the same area as the second target pixel p1 set at Step S404, the processing at Step S416 may be performed, and when the surrounding pixel p4 is not the pixel in the same area as the second target pixel p1 set at Step S404, the processing at Step S430 may be performed. If the processing is performed in this manner, the angle data of the second target pixel p1 is set based on the angle data corresponding to the pixel in the same divided area as the second target pixel p1, among the surrounding pixels p4. As a result, the embroidery data generating apparatus 1 in this case can generate the embroidery data to form the embroidery pattern that even more appropriately expresses changes in color of the whole image by the stitches.

(H) The deletion processing shown in FIG. 22 can be modified as appropriate. For example, Sum may be calculated when a smaller angle of the angles that are formed by the target line segment L2 represented by the target line segment data L1 and a line segment intersecting with the target line segment L2 is smaller than a threshold value (30 degrees, for example). In this case, it can be determined whether to delete the target line segment data L1 while taking into account the number of line segments intersecting with the target line segment L2 and the angles formed by the target line segment L2 and the line segments intersecting with the target line segment L2. For example, the target line segment data L1 corresponding to the target line segment L2 may be deleted in accordance with the number of intersecting line segments for which the smaller angle of the angles that are formed by each of the intersecting line segments intersecting with the target line segment L2 represented by the target line segment data L1 and the target line segment L2 is equal to or greater than the threshold value. As another example, in place of Sum, an average value of $\Delta\alpha$ may be compared with the threshold value. Alternatively, for example, the processing at Step S504 and at Step S514 shown in FIG. 22 may be omitted as necessary. In this ease, in comparison to a case in which the processing at Step S504 and Step S514 is performed, the embroidery data generating apparatus 1 can simplify the deletion processing. The embroidery data generating apparatus 1 can generate the embroidery data that forms stitches having a similar direction over the whole embroidery pattern.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery data generating apparatus comprising:

a thread color acquisition device that acquires, as a plurality of available thread colors, colors of threads to be used in sewing an embroidery pattern;

a first line segment data generating device that reads at least one of the pixels as a first target pixel from a plurality of pixels included in an image, and generates first line segment data that is data representing a first line segment based on target image data that is data representing the first target pixel, the first line segment being a line segment that expresses the first target pixel;

an expanded data generating device that, based on the first line segment data generated by the first line segment data generating device, generates expanded data that associates angle data with a pixel for each of the plurality of pixels overlapping with the first line segment, the angle data representing an extension direction of the first line segment as an angle of the first line segment with respect to a reference;

a second line segment data generating device that reads one of the pixels as a second target pixel from the plurality of pixels included in the expanded data to identify a pixel as an extension direction pixel, and generates second line segment data that represents a second line segment, the pixel identified as the extension direction pixel being in an extension direction as seen from the second target pixel, the extension direction being represented by target angle data that is the angle data associated with the second target pixel, the pixel identified as the extension direction pixel being associated with angle data indicating a similar angle to an angle indicated by the target angle data, the second line segment being a line segment that overlaps with the second target pixel and the extension direction pixel;

a color allocating device that, from among the plurality of available thread colors acquired by the thread color acquisition device, allocates to each piece of the second line segment data a thread color that expresses a color of a pixel that overlaps with the second line segment, as an embroidery thread color, the second line segment data representing the second line segment;

a connecting line segment data generating device that, when there is a plurality of line segments of the same color, which are line segments represented by the second line segment data having the same embroidery thread color allocated by the color allocating device, generates connecting line segment data that is data representing connecting line segments, which are line segments to connect the plurality of line segments of the same color; and an embroidery data generating device that generates embroidery data including a sewing order, thread color data and needle drop point data, based on the second line segment data generated by the second line segment data generating device, the embroidery thread color allocated to each piece of the second line segment data by the color allocating device and the connecting line segment data generated by the connecting line segment data generating device.

2. The embroidery data generating apparatus according to claim 1, further comprising:

a dividing device that, based on image data, divides a whole area of the image into a plurality of divided areas, the image data representing the image; and an associating device that allocates, to the expanded data, data that represents associated relationships between the plurality of divided areas generated by the dividing device and the pixels included in each of the plurality of divided areas;

wherein the second line segment data generating device refers to the expanded data, and identifies a pixel, from the plurality of pixels in the expanded data, as the extension direction pixel to generate the second line segment data, the pixel identified as the expansion direction pixel being in the extension direction represented by the target angle data as seen from the second target pixel, and in the same divided area as the second target pixel and being associated with angle data indicating a similar angle to an angle indicated by the target angle data.

3. The embroidery data generating apparatus according to claim 1, further comprising:

a detecting device that refers to the expanded data generated by the expanded data generating device and detects, from among the plurality of pixels, an unset pixel, which is a pixel that has not been associated with the angle data; and an updating device that, when the unset pixel is detected by the detecting device, sets angle data corresponding to the unset pixel based on surrounding angle data, to update the expanded data, the surrounding angle data piece being an angle data piece corresponding to a surrounding pixel among angle data pieces included in the expanded data, is the surrounding pixel being a pixel within a predetermined distance of the unset pixel;

wherein, when the expanded data is updated by the updating device, the second line segment data generating device generates the second line segment data by referring to updated expanded data.

4. The embroidery data generating apparatus according to claim 3, wherein:

the detecting device reads in a predetermined order the pixels that are in the extension direction represented by the target angle data as seen from the second target pixel, and detects the unset pixel; and when the unset pixel is detected by the detecting device, the updating device sets, as angle data of the unset pixel, angle data corresponding to a pixel, among the surrounding pixels, that is read in advance of the unset pixel to update the expanded data.

5. The embroidery data generating apparatus according to claim 3, wherein when the unset pixel is detected by the detecting device, the updating device refers to the expanded data, sets specific surrounding angle data as angle data of the detected unset pixel and updates the expanded data, the specific surrounding angle data being data identified from among the surrounding angle data, and being data that has, of the pixels in the extension direction represented by the surrounding angle data as seen from the detected unset pixel, a highest number of at least one of the unset pixels and the pixels that are associated with angle data indicating a similar angle to the surrounding angle data.

6. The embroidery data generating apparatus according to claim 3, further comprising:

a dividing device that, based on image data, divides a whole area of the image into a plurality of divided areas, the image data representing the image; and an associating device that allocates, to the expanded data, data that indicates associated relationships between the plurality of divided areas generated by the dividing device and the pixels included in each of the plurality of divided areas;

wherein, when the unset pixel is detected by the detecting device, the updating device identifies as an area pixel a pixel that is in the same divided area as the unset pixel, from among the surrounding pixels of the unset pixel, then sets angle data corresponding to the unset pixel, based on angle data associated with the area pixel, and updates the expanded data.

7. The embroidery data generating apparatus according to claim 1, further comprising:

an intersecting pixel identifying device that, of the angle data pieces corresponding to the pixels in the extension direction represented by the target angle data as seen from second target pixel among the angle data pieces of the expanded data, reads the angle data piece as reference angle data in a predetermined order, and, when an absolute value of a smaller angle among angles formed by an extension direction represented by the reference angle data and the extension direction represented by the target angle data is larger than zero and smaller than a first predetermined value, identifies the reference angle data as intersecting angle data to identify a pixel associated with the intersecting angle data as an intersecting pixel;

wherein, when the intersecting pixel is identified by the intersecting pixel identifying device, the second line segment data generating device generates data as the second line segment data in accordance with a number of the pixels that are in the extension direction represented by the intersecting angle data as seen from the intersecting pixel and that are also associated with the angle data indicating an angle that is similar to the intersecting angle data, the generated second line segment data representing two line segments, one of the two line segments being a line segment extending from the intersecting pixel in the extension direction represented by the intersecting angle data, the other of the two line segments being a line segment extending from the intersecting pixel in the extension direction represented by the target angle data, the two line segments being connected to each other at the intersecting pixel.

8. The embroidery data generating apparatus according to claim 1, further comprising:

a calculating device that, with respect to target line segment data that is data read from among the first line segment data pieces generated by the first line segment data generating device, identifies a pixel as a within range pixel, from among the plurality of pixels, and calculates an absolute value of a difference between an angle indicated by the angle data associated with the identified within range pixel and an angle of the target line segment, the pixel identified as the within range pixel being at a distance equal to or less than a second predetermined value from a target line segment that is the first line segment represented by the target line segment data; and a deleting device that, when a value calculated using the absolute value calculated by the calculating device is larger than a third predetermined value, deletes at least one of the target line segment data and the angle data representing the extension direction of the target line segment associated with the pixels overlapping with the target line segment included in the expanded data.

9. The embroidery data generating apparatus according to claim 8, further comprising:

an extracting device that, from the plurality of pixels, extracts as a low frequency pixel a pixel of an area other than a high frequency area, which is an area that has a spatial frequency component larger than a fourth predetermined value;

wherein the calculating device takes as the second target pixel the low frequency pixel extracted by the extracting device.

10. A non-transitory computer-readable medium storing an embroidery data generating program, the program comprising instructions that cause a controller to perform the steps of:

acquiring, as a plurality of available thread colors, colors of a plurality of threads to be used in sewing an embroidery pattern;

reading at least one of the pixels as a first target pixel from among a plurality of pixels included in an image, and generating first line segment data that is data representing a first line segment based on target image data that is data representing the first target pixel, the first line segment being a line segment that expresses the first target pixel;

generating, based on the first line segment data, expanded data that associates angle data with pixel for each of the plurality of pixels overlapping with the first line segment, the angle data representing an extension direction of the first line segment as an angle of the first line segment with respect to a reference;

reading one of the pixels as a second target pixel from the plurality of pixels included in the expanded data to identify a pixel as an extension direction pixel and generating second line segment data that represents a second line segment, the pixel identified as the extension direction pixel being in an extension direction as seen from the second target pixel, the extension direction being represented by target angle data that is the angle data associated with the second target pixel, the pixel identified as the extension direction pixel being associated with angle data indicating a similar angle to an angle indicated by the target angle data, the second line segment being a line segment that overlaps with the second target pixel and the extension direction pixel;

allocating, from among the plurality of available thread colors, to each piece of the second line segment data a thread color that expresses a color of a pixel that overlaps with the second line segment as an embroidery thread color, the second line segment data representing the second line segment;

generating, when there is a plurality of line segments of the same color, which are line segments represented by the second line segment data having the same embroidery thread color, connecting line segment data that is data representing connecting line segments, which are line segments to connect the plurality of line segments of the same color; and generating embroidery data including a sewing order, thread color data and needle drop point data, based on the second line segment data, the embroidery thread color allocated to each piece of the second line segment data and the connecting line segment data.

11. The non-transitory computer-readable medium according to claim 10, wherein the program further includes an instruction that causes the controller of the sewing machine to perform the steps of:

generating, based on image data, a plurality of divided areas that are areas obtained by dividing a whole area of the image, the image data representing the image;

allocating, to the expanded data, data that indicates associated relationships between the plurality of divided areas and the pixels included in each of the plurality of divided areas; and referring to the expanded data, identifying a pixel, from the plurality of pixels in expanded data, as the extension direction pixel to generate the second line segment data, the pixel identified as the extension direction pixel being in an extension direction represented by the target angle data as seen from the second target pixel and in the same divided area as the second target pixel and being associated with angle data indicating a similar angle to an angle indicated by the target angle data.

12. The non-transitory computer-readable medium according to claim 10, wherein the program further includes an instruction that causes the controller of the sewing machine to perform the steps of:

referring to the expanded data and detecting, from among the plurality of pixels, an unset pixel, which is a pixel that has not been associated with the angle data; and setting, when the unset pixel is detected, angle data corresponding to the unset pixel based on surrounding angle data, to update the expanded data, the surrounding angle data piece being an angle data piece corresponding to a surrounding pixel that is a pixel within a predetermined distance of the unset pixel, and updating the expanded data; and generating the second line segment data by referring to the updated expanded data, when the expanded data is updated.

13. The non-transitory computer-readable medium according to claim 12, wherein:

the pixels that are in the extension direction represented by the target angle data as seen from the second target pixel are read in a predetermined order, and the unset pixel is detected; and when the unset pixel is detected, as angle data of the unset pixel, angle data is set that corresponds to, of the surrounding pixels, a pixel that is read is advance of the unset pixel to update the expanded data.

14. The non-transitory computer-readable medium according to claim 12, wherein:

when the unset pixel is detected, the expanded data is referred to, specific surrounding angle data is set as angle data of the detected unset pixel and the expanded data is updated, the specific surrounding angle data being data identified from among the surrounding angle data, and being data that has, of the pixels in the extension direction represented by the surrounding angle data as seen from the detected unset pixel, a highest number of at least one of the unset pixels and the pixels that are associated with angle data indicating a similar angle to the surrounding angle data.

15. The non-transitory computer-readable medium according to claim 12, wherein the program further includes an instruction that causes the controller of the sewing machine to perform the steps of:

generating, based on image data, a plurality of divided areas that are areas obtained by dividing a whole area of the image, the image data representing the image;

allocating, to the expanded data, data that indicates associated relationships between the plurality of divided areas and the pixels included in each of the plurality of divided areas; and identifying as an area pixel, when the unset pixel is detected, a pixel that is in the same divided area as the unset pixel, from among the surrounding pixels of the unset pixel, setting angle data corresponding to the unset pixel based on angle data associated with the area pixel and updating the expanded data.

16. The non-transitory computer-readable medium according to claim 10, wherein the program further includes an instruction that causes the controller of the sewing machine to perform the steps of:

reading the angle data pieces as reference angle data and in a predetermined order, of the angle data pieces corresponding to the pixels in the extension direction represented by the target angle data as seen from second target pixel among the angle data pieces of the expanded data, and, when an absolute value of a smaller angle among angles formed by an extension direction represented by the reference angle data and the extension direction represented by the target angle data is larger than zero and smaller than a first predetermined value, identifying the reference angle data as intersecting angle data to identify, as an intersecting pixel, a pixel that is associated with the intersecting angle data; and when the intersecting pixel is identified, generating data as the second line segment data and in accordance with a number of the pixels that are in the extension direction represented by the intersecting angle data as seen from the intersecting pixel and that are also associated with the angle data indicating an angle that is similar to the intersecting angle data, the generated second line segment data representing two line segments, one of the two line segments being a line segment extending from the intersecting pixel in the extension direction represented by the intersecting angle data the other of the two line segments being a line segment extending from the intersecting pixel in the extension direction represented by the target angle data, the two line segments being connected to each other at the intersecting pixel.

17. The non-transitory computer-readable medium according to claim 10, wherein the program further includes an instruction that causes the controller of the sewing machine to perform the steps of:

identifying a pixel as a within range pixel, with respect to target line segment data pieces from among the first line segment data pieces, from among the plurality of pixels, and calculating an absolute value of a difference between an angle indicated by the angle data associated with the identified within range pixel and an angle of the target line segment, the pixel identified as the within range pixel being at a distance equal to or less than a second predetermined value from a target line segment that is the first line segment represented by the target line segment data; and deleting, when a value calculated using the absolute value is larger than a third predetermined value, at least one of the target line segment data and the angle data representing the extension direction of the target line segment associated with the pixels overlapping with the target line segment included in the expanded data.

18. The non-transitory computer-readable medium according to claim 17, wherein the program further includes an instruction that causes the controller of the sewing machine to perform the steps of:

extracting as a low frequency pixel, from the plurality of pixels, a pixel of an area other than a high frequency area, which is an area that has a spatial frequency component larger than a fourth predetermined value; and taking the low frequency pixel as the second target pixel.

* * * * *